US008487832B2

(12) United States Patent
Lam et al.

(10) Patent No.: US 8,487,832 B2
(45) Date of Patent: Jul. 16, 2013

(54) STEERING RADIO FREQUENCY BEAMS USING NEGATIVE INDEX METAMATERIAL LENSES

(75) Inventors: Tai Anh Lam, Kent, WA (US); Minas Hagop Tanielian, Bellevue, WA (US); Claudio Gilbert Parazzoli, Seattle, WA (US); John Stephen Derov, Lowell, MA (US)

(73) Assignee: The Boeing Company, Chicago, IL (US)

( * ) Notice: Subject to any disclaimer, the term of this patent is extended or adjusted under 35 U.S.C. 154(b) by 702 days.

(21) Appl. No.: 12/689,003

(22) Filed: Jan. 18, 2010

(65) Prior Publication Data

US 2012/0274525 A1 Nov. 1, 2012

Related U.S. Application Data

(63) Continuation-in-part of application No. 12/411,575, filed on Mar. 26, 2009, which is a continuation of application No. 12/046,940, filed on Mar. 12, 2008, now Pat. No. 8,130,171.

(51) Int. Cl.
*H01Q 15/24* (2006.01)

(52) U.S. Cl.
USPC ..... 343/909

(58) Field of Classification Search
USPC ..... 343/753–755, 711, 909, 872; 342/54, 342/368, 374
See application file for complete search history.

(56) References Cited

U.S. PATENT DOCUMENTS

| | | | |
|---|---|---|---|
| 2,459,800 | A | 1/1949 | Esgate |
| 3,697,898 | A | 10/1972 | Blachier et al. |
| 3,877,014 | A | 4/1975 | Mailloux |
| 4,721,933 | A | 1/1988 | Schwartz et al. |
| 5,012,211 | A | 4/1991 | Young et al. |
| 5,283,587 | A | 2/1994 | Hirschfield et al. |
| 5,517,203 | A | 5/1996 | Fiedziuszko |
| 5,629,266 | A | 5/1997 | Lithgow et al. |
| 5,804,534 | A | 9/1998 | Zaki |
| 5,838,213 | A | 11/1998 | Huang |

(Continued)

FOREIGN PATENT DOCUMENTS

| | | | |
|---|---|---|---|
| EP | 1496570 | A1 | 1/2005 |
| GB | 1402338 | A | 8/1975 |

(Continued)

OTHER PUBLICATIONS

USPTO office action for U.S. Appl. No. 12/046,940 dated Nov. 10, 2010.

(Continued)

*Primary Examiner* — Huedung Mancuso
(74) *Attorney, Agent, or Firm* — Yee & Associates, P.C.

(57) ABSTRACT

A method and apparatus are present for steering a radio frequency beam. The radio frequency beam is emitted from an array of antenna elements at a first angle into a lens at a location for the lens. The first angle of the radio frequency beam is changed to a second angle when the radio frequency beam exits the lens. The second angle changes when the location at which the radio frequency beam enters the lens changes. The second angle of the radio frequency beam is changed to a third angle when the radio frequency beam with the second angle passes through a negative index metamaterial lens located over the lens.

21 Claims, 20 Drawing Sheets

U.S. PATENT DOCUMENTS

| | | | | |
|---|---|---|---|---|
| 5,889,449 | A | 3/1999 | Fiedziuszko | |
| 5,905,472 | A | 5/1999 | Wolfson et al. | |
| 6,215,443 | B1 | 4/2001 | Komatsu et al. | |
| 6,281,769 | B1 | 8/2001 | Fiedziuszko | |
| 6,292,134 | B1 | 9/2001 | Bondyopadhyay | |
| 6,323,817 | B1 | 11/2001 | Ramanujam et al. | |
| 6,424,313 | B1 | 7/2002 | Navarro et al. | |
| 6,507,319 | B2 | 1/2003 | Sikina | |
| 6,603,374 | B1 | 8/2003 | Goertz et al. | |
| 6,670,930 | B2 | 12/2003 | Navarro | |
| 6,822,622 | B2 | 11/2004 | Crawford et al. | |
| 6,958,729 | B1 | 10/2005 | Metz | |
| 7,006,051 | B2 | 2/2006 | El-Mahdawy et al. | |
| 7,006,052 | B2 | 2/2006 | Delgado et al. | |
| 7,218,285 | B2 | 5/2007 | Davis et al. | |
| 7,463,109 | B2 | 12/2008 | Iio | |
| 7,538,946 | B2 | 5/2009 | Smith et al. | |
| 7,714,782 | B2 | 5/2010 | Davis et al. | |
| 7,724,180 | B2 | 5/2010 | Yonak et al. | |
| 7,855,691 | B2 | 12/2010 | Yonak et al. | |
| 7,928,900 | B2 * | 4/2011 | Fuller et al. | 342/175 |
| 8,130,170 | B2 | 3/2012 | Nakahata et al. | |
| 8,130,171 | B2 | 3/2012 | Lam et al. | |
| 8,164,531 | B2 | 4/2012 | Lier | |
| 8,294,538 | B2 | 10/2012 | Ueda | |
| 2003/0227350 | A1 | 12/2003 | Abdelmonem | |
| 2005/0116874 | A1 | 6/2005 | El-Mahdawy et al. | |
| 2005/0225492 | A1 | 10/2005 | Metz | |
| 2006/0255875 | A1 | 11/2006 | Iio | |
| 2007/0285315 | A1 * | 12/2007 | Davis et al. | 342/377 |
| 2008/0272955 | A1 | 11/2008 | Yonak et al. | |
| 2009/0289863 | A1 * | 11/2009 | Lier | 343/753 |
| 2010/0060388 | A1 | 3/2010 | Ueda | |
| 2010/0079354 | A1 * | 4/2010 | Lam et al. | 343/909 |
| 2010/0104823 | A1 | 4/2010 | Hyde et al. | |
| 2010/0200736 | A1 | 8/2010 | Laycock et al. | |
| 2010/0277398 | A1 * | 11/2010 | Lam et al. | 343/909 |
| 2010/0328175 | A1 | 12/2010 | Lam et al. | |
| 2011/0115684 | A1 | 5/2011 | Greegor et al. | |
| 2012/0086463 | A1 | 4/2012 | Boybay et al. | |

FOREIGN PATENT DOCUMENTS

| | | | |
|---|---|---|---|
| WO | WO9812767 | | 3/1998 |
| WO | 2005093905 | A1 | 10/2005 |
| WO | 2006023195 | A2 | 3/2006 |
| WO | WO2009148645 | | 12/2009 |
| WO | WO2010144170 | | 12/2010 |
| WO | WO2011062719 | | 5/2011 |

OTHER PUBLICATIONS

Pendry et al., "The Quest for the Superlens", 2006, retrieved Dec. 14, 2010 http://www.cmth.ph.ic.ac.uk/photonics/Newphotonics/pdf/sciam-pendry-4a.pdf.

PCT search report for application PCT/US2010/028364 dated Dec. 30, 2010.

PCT International Search Report for application PCT/US2010/053247 dated Feb. 2, 2011.

Bahrami et al., "Using Complementary split ring resonators to design bandpass waveguide filters", 2007 Asia-Pacific Microwave Conference, IEEE Piscataway, NJ, 2008, pp. 2341-2344.

Lam et al., "Experimental observation of the electric coupling effect in split ring resonators and the prevention", Physica Status Solidi a Wiley-VCH Verlag GMBH Germany, vol. 204, No. 12, Dec. 2007, pp. 3975-3978.

Mohd Asmidar Bin Abdul Wahab et al., "An investigation of square split-ring resonator as antenna operating at Terahertz frequency", Applied Electromagnetics, 2007, Asia Pacific Conference on, IEEE Piscataway NH, Dec. 4, 2007, pp. 1-6.

Ortiz et al., "Complementary split-ring resonator for compact waveguide filter design", Microwave and Optical Technology Letters, Wiley IUSA, vol. 46, No. 1, Jul. 5, 2005, pp. 88-92.

Bilotti et al., "Theoretical and experimental analysis of magnetic inclusionsfor the realization of metamaterials at different frequencies", Microwave Symposium 2007 IEEE/MTT-S International, IEEE, Jun. 1, 2007, pp. 1835-1838.

Jitha et al., "SRR loaded waveguide band rejection filter with adjustable bandwidth", Microwave and Optical Technology Letters, Wiley USA, vol. 48, No. 7, Jul. 2006, pp. 1427-1429.

Notice of Allowance issued on Oct. 11, 2011 for U.S. Appl. No. 12/046,940.

USPTO final office action dated Mar. 14, 2012 regarding U.S. Appl. No. 12/491,554, 13 Pages.

USPTO notice of allowance dated Mar. 7, 2012 regarding U.S. Appl. No. 12/411,575, 21 Pages.

USPTO final office action dated May 22, 2012 regarding U.S. Appl. No. 12/621,957, 29 Pages.

Hunter et al., "Microwave Filters—Applications and Technology," IEEE Transactions on Microwave Theory and Techniques, vol. 50, No. 3, pp. 794-805, Mar. 2002 (abstract).

Smith et al., "Gradient Index Metamaterials," Physical Review, edition 71, Mar. 2005, pp. 1-6.

PCT search report dated Dec. 30, 2010 regarding application PCT/US2010/028364, filing date Mar. 23, 2010, applicant The Boeing Company, 14 Pages.

PCT search report dated Feb. 24, 2010 regarding application PCT/US2009/035072, filing date Feb. 25, 2009, applicant The Boeing Company, 3 Pages.

U.S. Appl. No. 12/491,554, filed Jun. 25, 2009, Lam et al.

U.S. Appl. No. 12/046,940, filed Mar. 12, 2008, Lam et al.

U.S. Appl. No. 12/411,575, filed Mar. 26, 2009, Lam et al.

U.S. Appl. No. 12/621,957, filed Nov. 19, 2009, Greegor et al.

Schoenlinner et al., "Wide-Scan Spherical-Lens Antennas for Automotive Radars", IEEE Transactions on Microwave Theory and Techniques, vol. 50, No. 9, Sep. 2002, pp. 2166-2175.

Mosallaei et al., "Nonuniform Luneburg and Two-Shell Lens Antennas: Radiation Characteristics and Design Optimization", IEEE Transactions on Antennas and Propagation, vol. 49, No. 1, Jan. 2001, pp. 60-69.

Xu et al., "Report on steerable antenna architectures and critical RF circuits performance", FP6-IST-2003-506745 CAPANINA, Information Society Technologies, Nov. 2006, pp. 1-85.

Parazzoli et al., "Experimental Verification and Simulation of Negative Index of Refraction Using Snell's Law", Physical Review Letters, vol. 90, No. 10, Mar. 14, 2003, The American Physical Society, pp. 1-4.

Greegor et al., "Microwave focusing and beam collimation using negative index of refraction lenses", IET Microw. Antennas Propag., 2007, 1, (1), pp. 108-115.

Schrank et al., "A Luneberg-Lens Update", IEEE Antennas and Propagation Magazine, vol. 37, No. 1, Feb. 1995, pp. 77-79.

Rahm et al., "Design of electromagnetic cloaks and concentrators using form-invariant coordinate transformations of Maxwell's equations", Photonics and Nanostructures—Fundaments and Applications 6 (2008) pp. 87-95.

Dong et al., "A Fast Ray-Trading Method for Microstrip Rotman Lens Analysis", Proceedings of 29th General Assembly of the International Union of Radio Science, Chicago IL, 2008, pp. 1-4.

Fuchs et al., "Design Optimization of Multishell Luneburg Lenses", IEEE Transactions on Antennas and Propagation, vol. 55, No. 2, Feb. 2007, pp. 283-289.

Gutman, "Modified Luneberg Lens" Journal of Applied Physics, vol. 25, No. 7, Jul. 1954, pp. 855-859.

Penney et al., "Broad Band Rotman Lens Simulations in FDTD", IEEE 2005, pp. 51-54.

Rausch et al., "Rotman Lens Design Issues", 2005 IEEE, pp. 35-38.

Rotman et al., "Wide-Angel Microwave Lens for Line Source Applications", IEEE Transactions on Antennas and Propagation, 1963, pp. 623-632.

Simon, "Analysis and Synthesis of Rotman Lenses", 22nd AIAA International Communications Satellite Systems Conference & Exhibit 2004, May 2004, Monterey, CA, pp. 1-11.

Lam et al., "Negative Index Metamaterial Lens for the Scanning Angle Enhancement of Phased-Array Antennas", Zouhdi et al. (eds.), Metamaterials and Plasmonics: Fundamentals, Modelling, Applications, The NATO Science for Peace and Security Programme, Springer Science + Business Media B.V. 2009, pp. 121-138.

Parazzoli et al., "Eikonal equation for a general anisotropic or chiral medium: application to a negative-graded index-of-refraction lens with an anisotropic material", Journal of Optical Society of America, vol. 23, No. 3, Mar. 2006, pp. 439-450.
Sparks et al., "Eight Beam Prototype Fiber Optic Rotman Lens", 1999 IEEE MWP'99 Digest, pp. 283-286.
USPTO Notice of Allowance dated Jul. 7, 2011, U.S. Appl. No. 12/046,940.
Lam et al., "Lens for Scanning Angle Enhancement of Phased Array Antennas," USPTO U.S. Appl. No. 13/615,222 and Preliminary Amendment, filed Sep. 13, 2012, 67 pages.
Final Office Action, dated Aug. 1, 2012, regarding USPTO U.S. Appl. No. 12/491,554, 10 pages.
Office Action, dated Dec. 5, 2012, regarding USPTO U.S. Appl. No. 12/491,554, 14 pages.
Notice of Allowance, dated Nov. 30, 2012, regarding USPTO U.S. Appl. No. 12/621,957, 11 pages.
Notice of Allowance, dated Mar. 15, 2013, regarding U.S. Appl. No. 12/411,575, 20 pages.
Office Action, dated May 16, 2013, regarding U.S. Appl. No. 13/615,222, 23 pages.

* cited by examiner

2500

| SIZE (mm) | CELL |
|---|---|
| d | 1.900 |
| w | 0.200 |
| wc | 0.160 |
| we | 0.155 |
| g | 0.200 |
| gc | 0.320 |
| L | 0.395 |

STEERING RADIO FREQUENCY BEAMS USING NEGATIVE INDEX METAMATERIAL LENSES

RELATED APPLICATION

The present invention is a continuation-in-part (CIP) of and claims priority to the following patent application: entitled "Lens for Scanning Angle Enhancement of Phased Array Antennas", Ser. No. 12/411,575, filed Mar. 26, 2009, and is incorporated herein by reference. Application Ser. No. 12/411,575 is itself a continuation of application Ser. No. 12/046,940, now issued as U.S. Pat. No. 8,130,171, and the present application also claims priority to U.S. application Ser. No. 12/046,940.

GOVERNMENT LICENSE RIGHTS

This invention was made with Government support under contract number HR0011-05-C-0068 awarded by the United States Defense Advanced Research Projects Agency. The government has certain rights in this invention.

BACKGROUND INFORMATION

1. Field

The present disclosure relates generally to lenses and, in particular, to lenses for use with antennas. Still more particularly, the present disclosure relates to a method and apparatus for steering a radio frequency beam using a negative index metamaterial lens.

2. Background

Phased array antennas have many uses. For example, phased array antennas may be used in broadcasting amplitude-modulated and frequency-modulated signals for various radio stations. As another example, phased array antennas are commonly used with seagoing vessels, such as warships. Phased array antennas allow a warship to use one radar system for surface detection and tracking, air detection and tracking, and missile uplink capabilities. Further, phased array antennas may be used to control missiles during the course of the missile's flight.

Additionally, phased array antennas are commonly used to provide communications between various vehicles. Phased array antennas also are used in communications with spacecraft. As another example, a phased array antenna may be used on a moving vehicle or seagoing vessel to communicate with an aircraft.

The elements in a phased array antenna may emit radio frequency signals to form a beam that can be steered through different angles. The beam may be emitted in a direction normal to the surface of the elements radiating the radio frequency signals. Through controlling the manner in which the signals are emitted, the direction may be changed. The changing of the direction is also referred to as steering. For example, many phased array antennas may be controlled to direct a beam at an angle of about 60 degrees from a normal direction from the arrays in the antenna. Depending on the usage, a capability to direct the beam at a higher angle, such as, for example, about 90 degrees, may be desirable.

Some currently used systems may employ a mechanically steered antenna to achieve greater angles. In other words, the antenna unit may be physically moved or tilted to increase the angle at which a beam may be steered. These mechanical systems may move the entire antenna. This type of mechanical system may involve a platform that may tilt the array in the desired direction. These types of mechanical systems, however, move the array at a rate that may be slower than desired to provide a communications link.

Therefore, it would be advantageous to have a method and apparatus to overcome the problems described above.

SUMMARY

In one advantageous embodiment, an apparatus comprises an array of antenna elements, a lens, and a metamaterial lens. The array of antenna elements is configured to emit a radio frequency beam. The lens is located over the array of antenna elements. The lens is configured to change a first angle at which the radio frequency beam enters the lens to a second angle when the radio frequency beam exits the lens. The second angle changes when a location at which the radio frequency beam enters the lens changes. The metamaterial lens is located over the lens. The metamaterial lens is configured to change the second angle at which the radio frequency beam enters the metamaterial lens to a third angle when the radio frequency beam exits the metamaterial lens.

In another advantageous embodiment, an antenna system comprises an array of antenna elements, a lens, a negative index metamaterial lens, and a controller. The array of antenna elements is configured to emit a radio frequency beam. The lens is located over the array of antenna elements. The lens is configured to change a first angle at which the radio frequency beam enters the lens to a second angle when the radio frequency beam exits the lens. The second angle changes when a location at which the radio frequency beam enters the lens changes. The negative index metamaterial lens is located over the lens. The negative index metamaterial lens has a buckyball shape and is configured to change the second angle at which the radio frequency beam enters the negative index metamaterial lens to a third angle when the radio frequency beam exits the negative index metamaterial lens. The controller is configured to select a number of antenna elements from the array of antenna elements to change the location at which the radio frequency beam enters the lens.

In another advantageous embodiment, a method is present for steering a radio frequency beam. The radio frequency beam is emitted from an array of antenna elements at a first angle into a lens at a location for the lens. The first angle of the radio frequency beam is changed to a second angle when the radio frequency beam exits the lens. The second angle changes when the location at which the radio frequency beam enters the lens changes. The second angle of the radio frequency beam is changed to a third angle when the radio frequency beam with the second angle passes through a negative index metamaterial lens located over the lens.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

DETAILED DESCRIPTION

The different advantageous embodiments recognize and take into account a number of different considerations. For example, the different advantageous embodiments recognize and take into account that phased array antennas have been commonly used in antenna systems because of their ability to steer a radio frequency beam electronically. This functionality may allow for desired beam steering speeds in addition to directional communication. The different advantageous embodiments, however, recognize and take into account that monolithic microwave integrated circuits that are used to implement phase shifters may be costly and increase the complexity of communication systems.

Thus, the different advantageous embodiments provide a method and apparatus for directing radio frequency beams. In one advantageous embodiment, an apparatus comprises an array of antenna elements, a lens, and a negative index metamaterial lens. The array of antenna elements is configured to emit a radio frequency beam. The lens is configured to change a first angle at which the radio frequency beam enters the lens to a second angle when the radio frequency beam exits the lens. The second angle changes when a location at which the radio frequency beam enters the lens changes. The negative index metamaterial lens is located over the lens and is configured to change the second angle at which the frequency beam enters the negative index metamaterial lens to a third angle when the radio frequency beam exits the negative index metamaterial lens.

Figure 1:
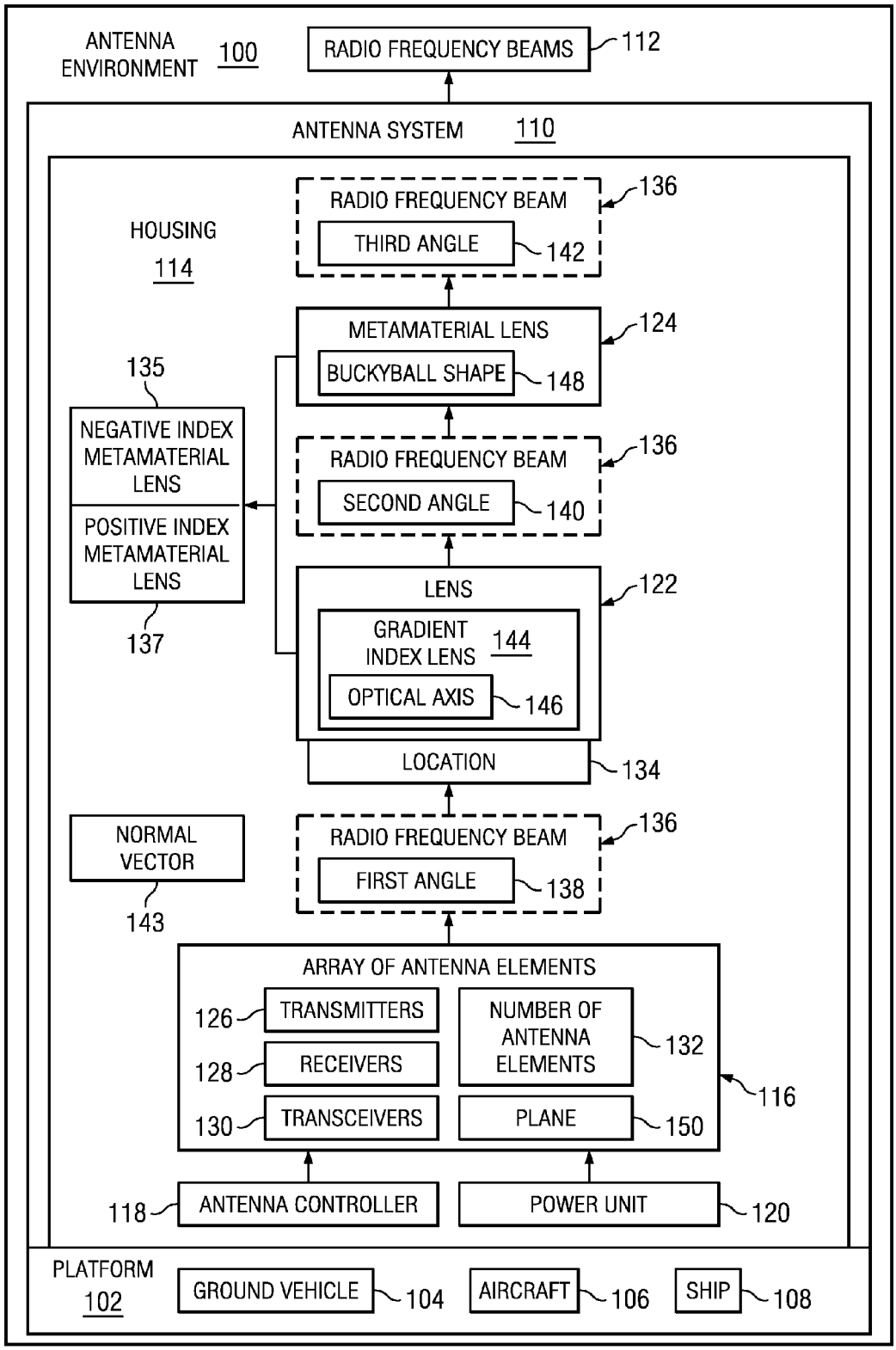
FIG. 1 is an illustration of an antenna environment in accordance with an advantageous embodiment.

With reference now to FIG. 1, an illustration of an antenna environment is depicted in accordance with an advantageous embodiment. In this illustrative example, antenna environment 100 includes platform 102. Platform 102 may take various forms. For example, platform 102 may be ground vehicle 104, aircraft 106, ship 108, and/or other suitable types of platforms.

Antenna system 110 is associated with platform 102. In these illustrative examples, antenna system 110 may send and receive radio frequency beams 112. Antenna system 110 comprises housing 114, array of antenna elements 116, antenna controller 118, power unit 120, lens 122, metamaterial lens 124, and/or other suitable components.

Housing 114 is the physical structure containing the different components for antenna system 110. Power unit 120 provides power in the form of voltages and currents used by array of antenna elements 116 to control the emission of microwave signals by array of antenna elements 116. These microwave signals are radio frequency emissions emitted by array of antenna elements 116 in the form of radio frequency beams 112.

In these illustrative examples, array of antenna elements 116 comprises at least one of transmitters 126, receivers 128, and transceivers 130. In these illustrative examples, antenna elements within array of antenna elements 116 may take various forms. For example, the antenna elements may be patch antennas, waveguide antennas, and/or other suitable types of antennas. Waveguide antennas may be used for the antenna elements and may be selected based on their ability to provide circular polarization.

In these illustrative examples, each of transmitters 126 within array of antenna elements 116 generates radio frequency signals in a manner that forms radio frequency beams 112. Antenna controller 118 may control which antenna elements within array of antenna elements 116 emit radio frequency signals to generate radio frequency beams 112. For example, antenna controller 118 may cause number of antenna elements 132 within array of antenna elements 116 to emit radio frequency beams 112. In these illustrative examples, a number of items means one or more items.

For example, number of antenna elements 132 is one or more antenna elements. Number of antenna elements 132 may comprise all of the antenna elements in array of antenna elements 116, depending on the manner in which antenna controller 118 controls array of antenna elements 116. Additionally, number of antenna elements 132 may be grouped together such that the antenna elements in number of antenna elements 132 are all adjacent to each other to form two or more groups. In this manner, multiple beams in radio frequency beams 112 may be generated.

Through the selection of number of antenna elements 132, location 134, at which radio frequency beams 112 emitted from array of antenna elements 116 enter lens 122, may be changed. In these different advantageous embodiments, lens 122 is configured to change the angle at which radio frequency beams 112 enters lens 122 to another angle when radio frequency beams 112 exit lens 122, depending on location 134.

For example, radio frequency beam 136 enters lens 122 at location 134 at first angle 138. Lens 122 changes first angle 138 to second angle 140 when radio frequency beam 136 exits lens 122. As location 134 at which radio frequency beam 136 enters lens 122 changes, second angle 140 also changes.

Radio frequency beam 136 enters metamaterial lens 124 at second angle 140. Metamaterial lens 124 may be, for example, negative index metamaterial lens 135 or positive index metamaterial lens 137. Metamaterial lens 124 changes second angle 140 to third angle 142 when radio frequency beam 136 exits metamaterial lens 124. Lens 122 also may be negative index metamaterial lens 135 or positive index metamaterial lens 137 in these illustrative examples.

The bending of radio frequency beam 136 may be from about zero degrees with respect to normal vector 143 to about 60 degrees from normal vector 143 or some other angle. In the different illustrative examples, lens 122 may be gradient index lens 144 with optical axis 146. In this depicted example, optical axis 146 may be substantially parallel to normal vector 143. Metamaterial lens 124 has buckyball shape 148.

In these illustrative examples, location 134 may be selected to steer radio frequency beam 136 in a desired direction. The steering occurs in the different advantageous embodiments without requiring mechanical components or physical movements of the antenna elements in array of antenna elements 116.

For example, if location 134 is through optical axis 146 of lens 122, radio frequency beam 136 may be bent about zero degrees relative to normal vector 143. In other words, radio frequency beam 136 may not have any change in angle from about zero degrees.

First angle 138 and second angle 140 may be substantially the same when radio frequency beam 136 travels through optical axis 146 of gradient index lens 144. In another value for location 134, first angle 138 may be about zero degrees, while second angle 140 may be about 60 degrees. With this example, third angle 142 may be about 90 degrees or substantially horizontal with respect to plane 150 through array of antenna elements 116.

In the different advantageous embodiments, metamaterial lens 124 provides a capability to increase the angle at which radio frequency beams 112 are bent from what lens 122 provides.

Metamaterial lens 124 is constructed using negative index metamaterials, positive index metamaterials, or a combination of negative index metamaterials and positive index metamaterials. Metamaterial lens 124 allows for additional bending of radio frequency beams 112 without requiring moving mechanical components as in other currently used solutions. Lens 122 also may be constructed using negative index metamaterials, positive index metamaterials, or a combination of negative index metamaterials and positive index metamaterials.

A metamaterial is a material that gains its properties from the structure of the material rather than directly from its composition. A metamaterial may be distinguished from other composite materials based on unusual properties that may be present in the metamaterial.

For example, the metamaterial may have a structure with a negative refractive index. This type of property is not found in naturally occurring materials. The refractive index is a measure of how the speed of light or other waves are reduced in a medium.

Further, a metamaterial also may be designed to have negative values for permittivity and permeability. Permittivity is a physical quantity that describes how an electrical field affects and is affected by a dielectric medium. Permeability is a degree of magnetism of a material that responds linearly to an applied magnetic field. In the different advantageous embodiments, metamaterial lens 124 is a lens that is formed with a metamaterial that has a negative index of refraction. This lens also may include other properties or attributes to bend radio frequency beams 112.

A positive index lens may be made out of metamaterial or ordinary dielectric material, assuming an appropriate but different shape. A positive index lens has an index of refraction greater than zero. In yet another advantageous embodiment, the lens could include both positive index achieved from ordinary dielectric materials or metamaterials and negative index metamaterials.

The illustration of antenna environment 100 in FIG. 1 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some advantageous embodiments, metamaterial lens 124 in antenna system 110 may have a different shape other than buckyball shape 148. For example, without limitation, in some advantageous embodiments, the shape may be a volume aligned between two ellipses. Of course, any shape that may provide the desired angle may be used for the lens.

Further, in other advantageous embodiments, lens 122 may be implemented using lenses other than gradient index lens 144. Any lens that may change the angle of radio frequency beams 112 from a first angle entering the lens to a second angle exiting the lens in which the second angle varies, depending on location 134, may be used.

Figure 2:
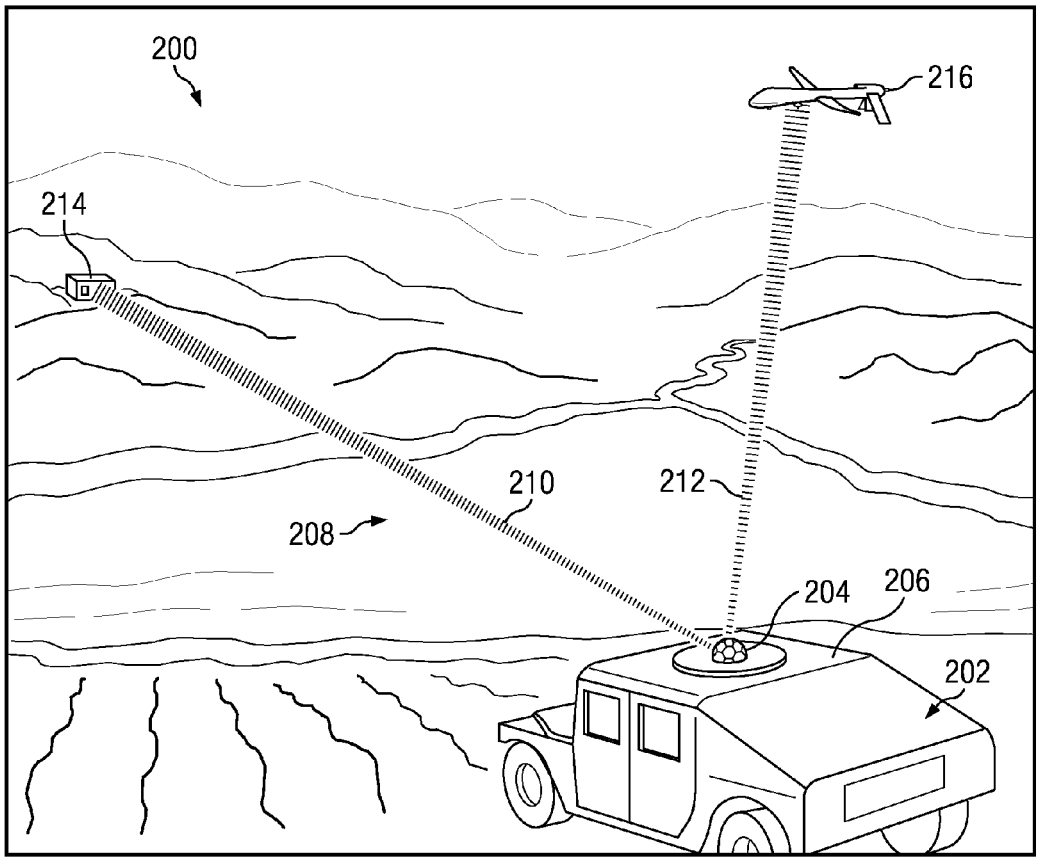
FIG. 2 is an illustration of an antenna environment in accordance with an advantageous embodiment.

With reference now to FIG. 2, an illustration of an antenna environment is depicted in accordance with an advantageous embodiment. Antenna environment 200 is an example of one implementation of antenna environment 100 in FIG. 1.

As illustrated, ground vehicle 202 has antenna system 204 on roof 206 of ground vehicle 202. In this illustrative example, antenna system 204 transmits radio frequency beams 208. As illustrated, radio frequency beams 208 include radio frequency beam 210 and radio frequency beam 212.

Radio frequency beam 210 is transmitted at target 214, while radio frequency beam 212 is transmitted at target 216. In other illustrative examples, radio frequency beam 210 may be received from target 214, while radio frequency beam 212 is transmitted at target 216.

In some advantageous embodiments, only a single rated frequency beam may be transmitted or received at a particular point in time. In other advantageous embodiments, other members of radio frequency beams 208 may be transmitted by antenna system 204. Radio frequency beams 208 may be used by ground vehicle 202 to provide functions, such as, for example, directional communication, anti-jamming capabilities, and/or other suitable functions.

Figure 3:
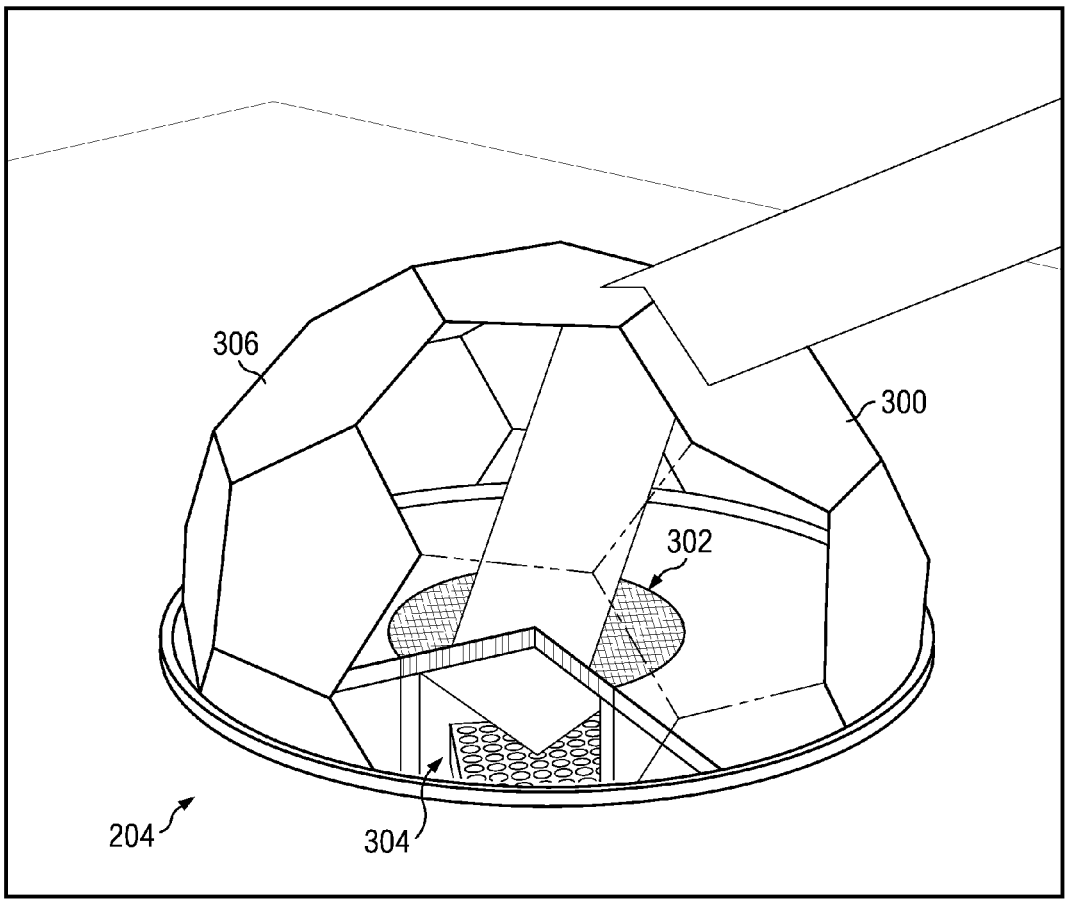
FIG. 3 is an illustration of an antenna system in accordance with an advantageous embodiment.

With reference now to FIG. 3, an illustration of an antenna system is depicted in accordance with an advantageous embodiment. In this illustration, a more detailed depiction of antenna system 204 is presented. Antenna system 204 is shown in an exposed view. Antenna system 204 includes negative index metamaterial lens 300. With this exposed view, lens 302 also may be seen within negative index metamaterial lens 300. Additionally, in this exposed view, array of antenna elements 304 also are illustrated for antenna system 204 as being located under lens 302.

Negative index metamaterial lens 300 is an example of one implementation for negative index metamaterial lens 135 in FIG. 1. Lens 302 is an example of one implementation of lens 122 in FIG. 1.

In this illustrative example, negative index metamaterial lens 300 has buckyball shape 306. Buckyball shape 306 is a truncated icosahedron. Buckyball shape 306 is shown as half of a buckyball in this example. Buckyball shape 306 may be a portion or all of a buckyball, depending on the particular implementation.

Figure 4:
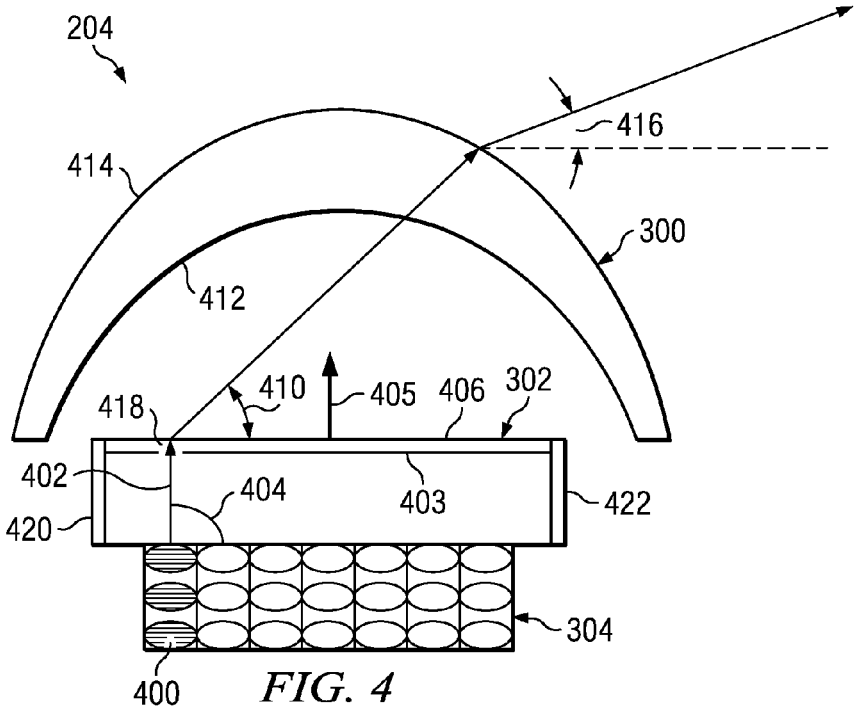
FIG. 4 is an illustration of an antenna system accordance with an advantageous embodiment.

With reference now to FIG. 4, an illustration of an antenna system is depicted in accordance with an advantageous embodiment. In this illustrative example, a cross-sectional view of antenna system 204 from FIGS. 2-3 is depicted. Cross-sectional views of array of antenna elements 304, lens 302, and negative index metamaterial lens 300 are depicted for antenna system 204.

In this illustrative example, antenna element 400 is in array of antenna elements 304. Antenna element 400 transmits radio frequency beam 402. Radio frequency beam 402 enters first surface 403 of lens 302 at first angle 404. Radio frequency beam 402 enters lens 302 in a direction corresponding to normal vector 405 in these examples. Lens 302 bends radio frequency beam 402. As a result, radio frequency beam 402 exits lens 302 at second surface 406 at second angle 410. In other words, lens 302 changes radio frequency beam 402 from first angle 404 to second angle 410 based on the properties within lens 302.

As radio frequency beam 402 enters negative index metamaterial lens 300, radio frequency beam 402 is bent or directed. As illustrated, radio frequency beam 402 enters first surface 412 of negative index metamaterial lens 300 at second angle 410. Negative index metamaterial lens 300 changes the direction of or bends radio frequency beam 402 such that radio frequency beam 402 exits second surface 414 of negative index metamaterial lens 300 at third angle 416. Third angle 416, in these examples, is relative to second angle 410 of radio frequency beam 402. Radio frequency beam 402 now travels at third angle 416.

In these illustrative examples, second angle 410 is determined by location 418 on lens 302. When location 418 changes, second angle 410 also changes. In turn, third angle 416 also changes direction based on the changes in location 418 and in second angle 410.

In these illustrative examples, antenna system 204 also includes absorber 420 and absorber 422. These absorbers provide structural support for lens 302 over array of antenna elements 304. Further, absorber 420 and absorber 422 absorb the electromagnetic radiation emitted by array of antenna elements 304 that does not pass through lens 302.

Figure 5:
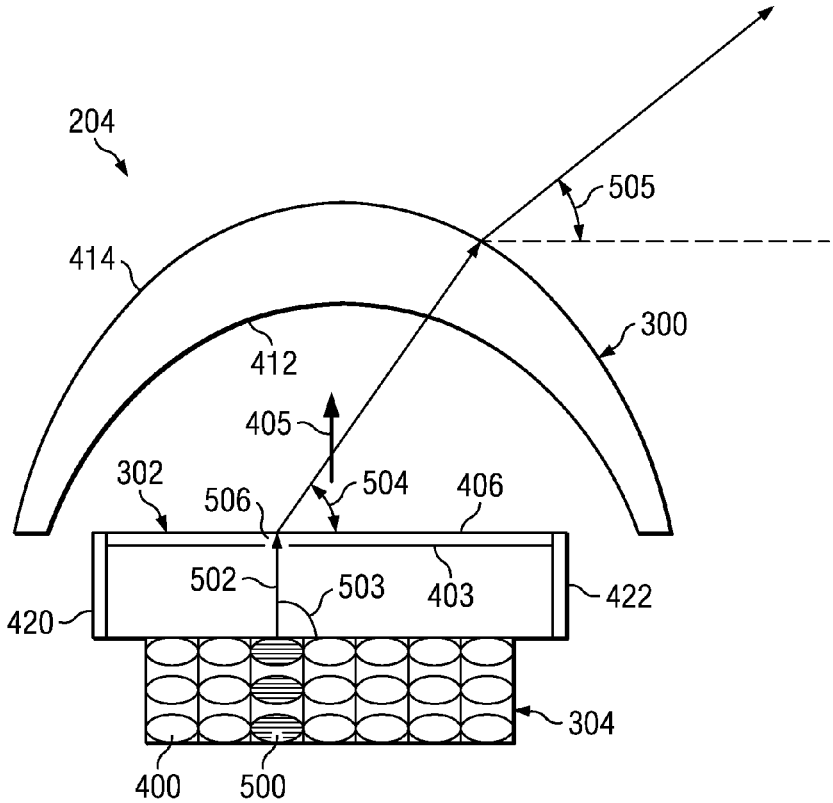
FIG. 5 is an illustration of an antenna system in accordance with an advantageous embodiment.

Turning now to FIG. 5, an illustration of an antenna system is depicted in accordance with an advantageous embodiment. In this illustration, antenna element 500 may be activated to emit radio frequency beam 502. In this example, radio frequency beam 502 has fourth angle 503. As radio frequency beam 502 enters first surface 403 of lens 302, radio frequency beam 502 has fourth angle 503. When radio frequency beam 502 exits second surface 406 of lens 302, radio frequency beam 502 is bent or redirected and has fifth angle 504. Fifth angle 504 is different from second angle 410 in FIG. 4 in these examples.

Fifth angle 504 is determined by location 506 for lens 302. As a result, when radio frequency beam 502 enters first surface 412 of negative index metamaterial lens 300 and exits at second surface 414 of negative index metamaterial lens 300, radio frequency beam 502 changes to sixth angle 505. As can be seen, the angle of radio frequency beam 502 may be changed based on the location at which radio frequency beam 502 passes through lens 302. In these illustrative examples, lens 302 has optical properties such that fifth angle 504 of radio frequency beam 502 may vary, depending on location 506 through which radio frequency beam 502 passes through lens 302.

Lens 302 has a focal length of about 5.5 centimeters such that f# is less than about 0.5 (f#=f.1./D). Lens 302 may be located about 5.5 centimeters above array of antenna elements 304. Absorber 420 and absorber 422 are used to position lens 302 at about 5.5 centimeters above array of antenna elements 304. Lens 302 has a circular shape with a radius of about 6 centimeters and a thickness of about 0.85 centimeters. Additionally, lens 302, in these examples, may be comprised of a material, such as Rexolite®, some other suitable type of plastic, or some other suitable type of material.

Array of elements 304 is a 7×7 array in these examples. With lens 302, the corner elements of array of elements 304 may broadcast a radio frequency beam that is about 38 degrees from the vertical ($\tan^{-1}(3\sqrt{2}/5.5)$) even before going through negative index metamaterial lens 300. In these examples, the lens is designed with an impedance match to free space such that an incoming radio frequency beam that is received by the lens has reduced reflections.

Figure 6:
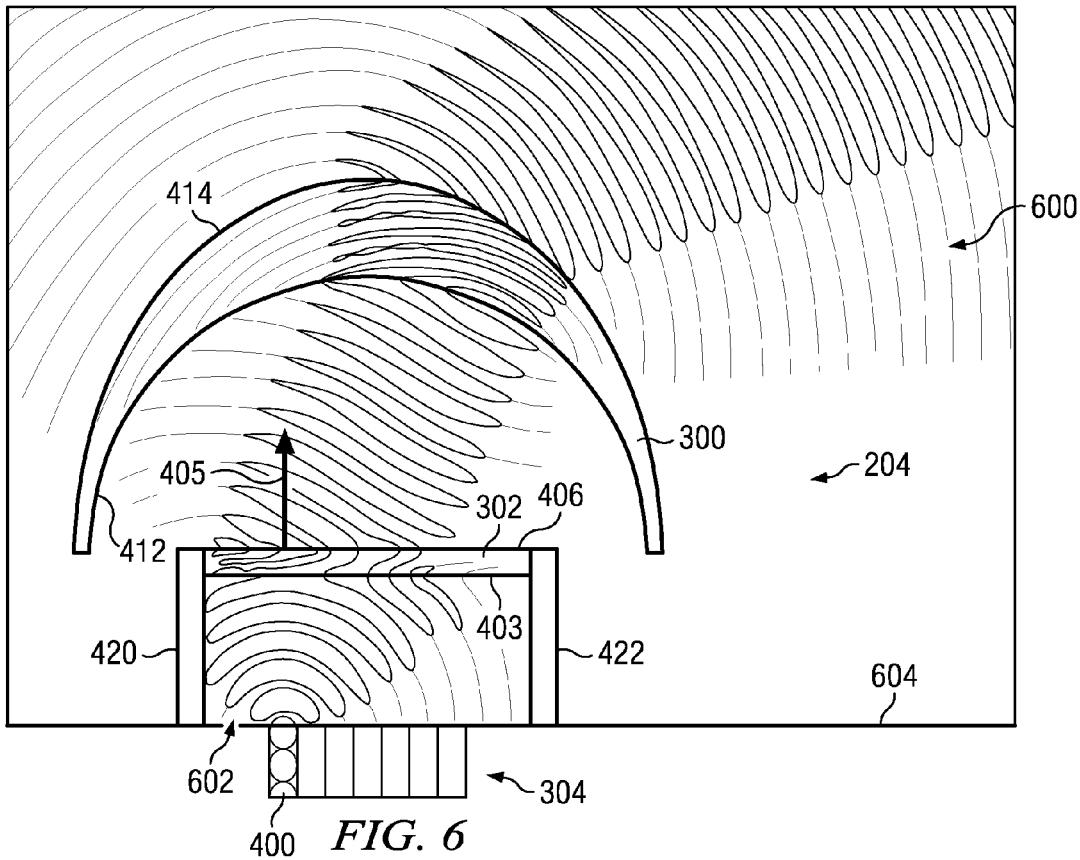
FIG. 6 is an illustration of an electric field plot for a simulation for an antenna system in accordance with an advantageous embodiment.

With reference now to FIG. 6, an illustration of an electric field from a simulation for an antenna system is depicted in accordance with an advantageous embodiment. In this illustrative example, electric field 600 is for a simulation using the configuration of antenna system 204 in FIGS. 2-5.

In this depicted example, antenna element 400 emits wave 602 with a semi-spherical shape into electric field 600. Wave 602 corresponds to the emission of radio frequency beam 402 by antenna element 400 as depicted in FIG. 4. Wave 602 enters first surface 403 of lens 302 and exits second surface 406 of lens 302. Absorber 420 and absorber 422 both absorb the electromagnetic radiation from wave 602 that does not pass through lens 302.

As depicted, wave 602 exits second surface 406 of lens 302 at an angle away from normal vector 405. In other words, wave 602 passes through lens 302 such that wave 602 is steered away from normal vector 405. Wave 602 exits lens 302 with a planar shape in electric field 600.

Wave 602 then passes through first surface 412 of negative index metamaterial lens 300 and exits second surface 414 of negative index metamaterial lens 300. Wave 602 exits second surface 414 at an angle even further away from normal vector 405. In other words, wave 602 is steered further away from normal vector 405 in a direction such that wave 602 exits second surface 414 of negative index metamaterial lens 300 at an angle closer to plane 604 than when exiting second surface 406 of lens 302.

Figure 7:
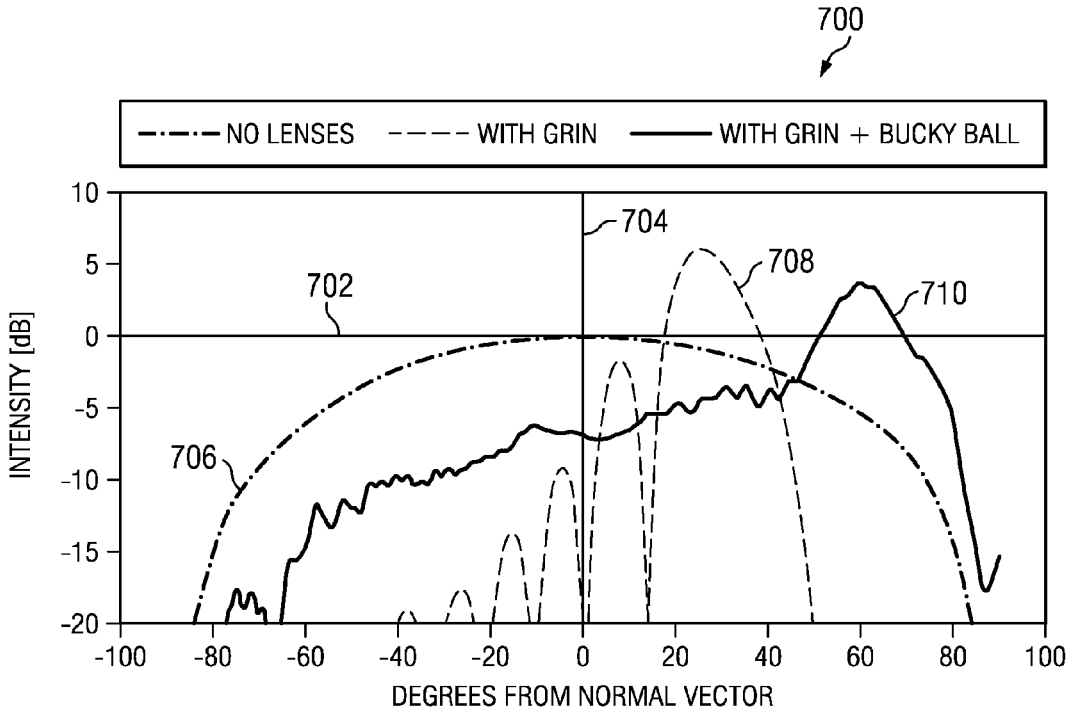
FIG. 7 is an illustration of a graph of intensities simulated using an antenna system in accordance with an advantageous embodiment.

With reference now to FIG. 7, an illustration of a graph of intensities simulated using an antenna system is depicted in accordance with an advantageous embodiment. In this illustrative example, graph 700 is for simulations using antenna system 204. Graph 700 has horizontal axis 702 and vertical axis 704. Horizontal axis 702 is degrees from normal vector 405. Vertical axis 704 is the intensity for the radio frequency beams generated by antenna system 204.

Curve 706 is for a simulation with antenna system 204 having array of antenna elements 304 without lens 302 and negative index metamaterial lens 300. Curve 708 is for a simulation with antenna system 204 having array of antenna elements 304 and lens 302 but without negative index metamaterial lens 300. Curve 710 is for a simulation with antenna system 204 having array of antenna elements 304, lens 302, and negative index metamaterial lens 300.

Figure 8:
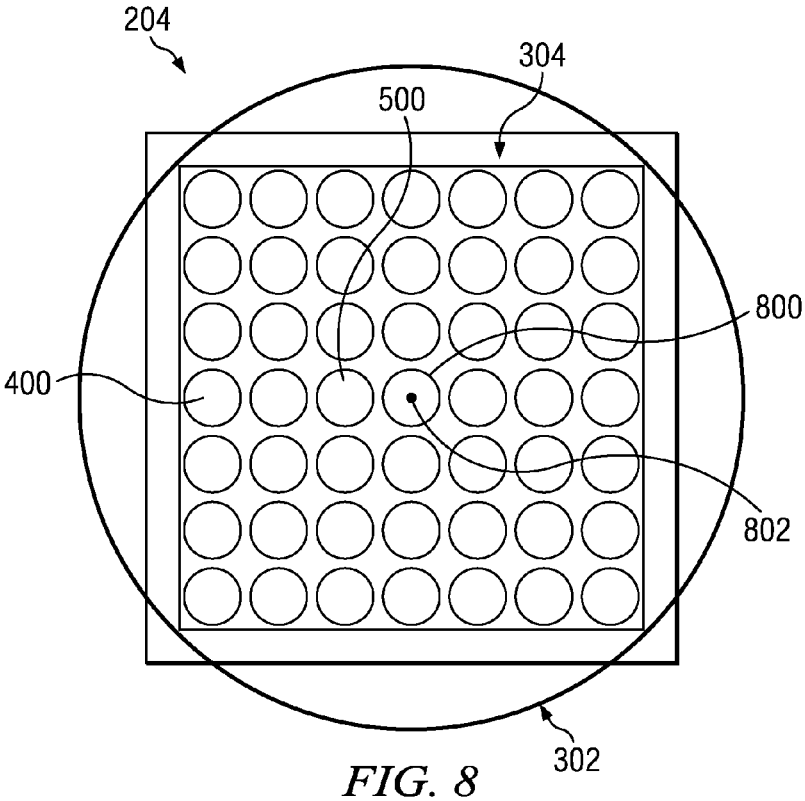
FIG. 8 is an illustration of a portion of an antenna system in accordance with an advantageous embodiment.

Turning now to FIG. 8, an illustration of a portion of an antenna system is depicted in accordance with an advantageous embodiment. In this illustrative example, a top view of antenna system 204 is depicted in accordance with an advantageous embodiment.

In this illustrative example, a top view of array of antenna elements 304 and lens 302 is depicted. In this example, array of antenna elements 304 has 49 antenna elements arranged in a 7×7 array. In this example, the array pitch is one centimeter such that the centers of the outer antenna elements in array of antenna elements 304 are on about a 6×6 centimeter square.

Antenna element 800 is the center antenna element and corresponds with optical axis 802 for lens 302. In this example, lens 302 is a gradient index lens. Each of these antenna elements may be activated individually or in groups, depending on the steering angle of interest. Of course, in some advantageous embodiments, a circular array rather than a square array may be used, depending on the particular implementation. As different antenna elements within array of antenna elements 304 are activated to transmit radio frequency beams, the angle at which the radio frequency beams exit lens 302 may vary, depending on the location through which the radio frequency beams pass through lens 302. In these illustrative examples, when a radio frequency beam is received by lens 302, the angle may be such that the radio frequency beam is substantially following a normal vector at about zero degrees.

The center antenna element axis for antenna element 800 coincides with optical axis 802 of the gradient index lens. The other antenna elements are off the optical axis by various distances. The corner antenna elements of the array has the farthest distance at $3\sqrt{2}=4.24$ cm. These antenna elements may be excited one element at a time, depending on the particular steering angle desired.

In this example, the steering angle may be defined by θ and ϕ. The angles θ and ϕ are relative to a normal vector taken with respect to a lattice plane. The ϕ angle may be from about zero to about 360 degrees, while the θ angle may be from about zero to about 180 degrees.

Figure 9:
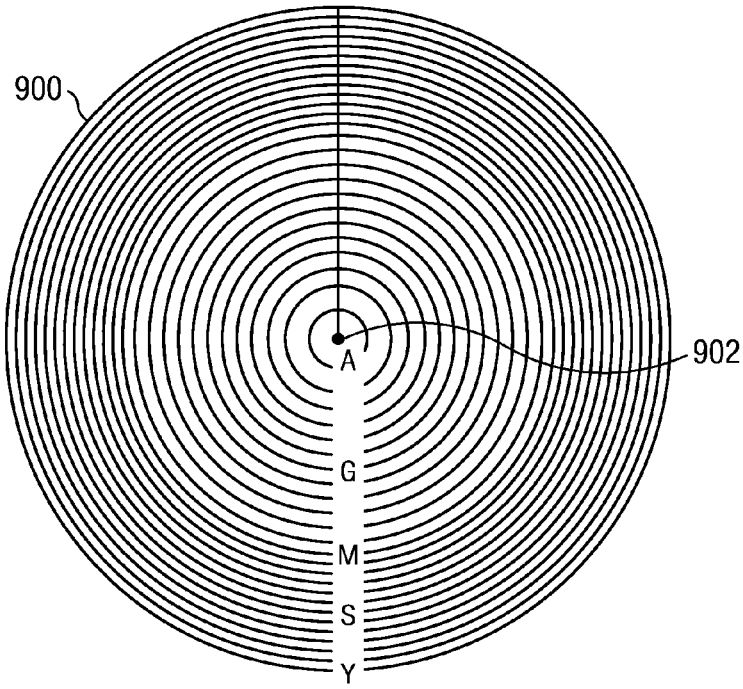
FIG. 9 is an illustration of a gradient index lens in accordance with an advantageous embodiment.

With reference now to FIG. 9, an illustration of a gradient index lens is depicted in accordance with an advantageous embodiment. In this illustrative example, gradient index lens 900 is an example of one implementation of gradient index lens 144 in FIG. 1 and lens 302 in FIGS. 3-6.

Gradient index lens 900 has optical axis 902. Radio frequency beams passing through gradient index lens 900 at an angle about zero degrees away from optical axis 902 may exit gradient index lens 900 at an angle about zero degrees from optical axis 902. Further, radio frequency beams passing through gradient index lens 900 at the same angle but at locations away from optical axis 902 may exit gradient index lens 900 at angles further away from optical axis 902.

In the different advantageous embodiments, gradient index lens 900 may be comprised of a material, such as, for example, without limitation, a negative index metamaterial and/or some other suitable type of material.

Figure 10:
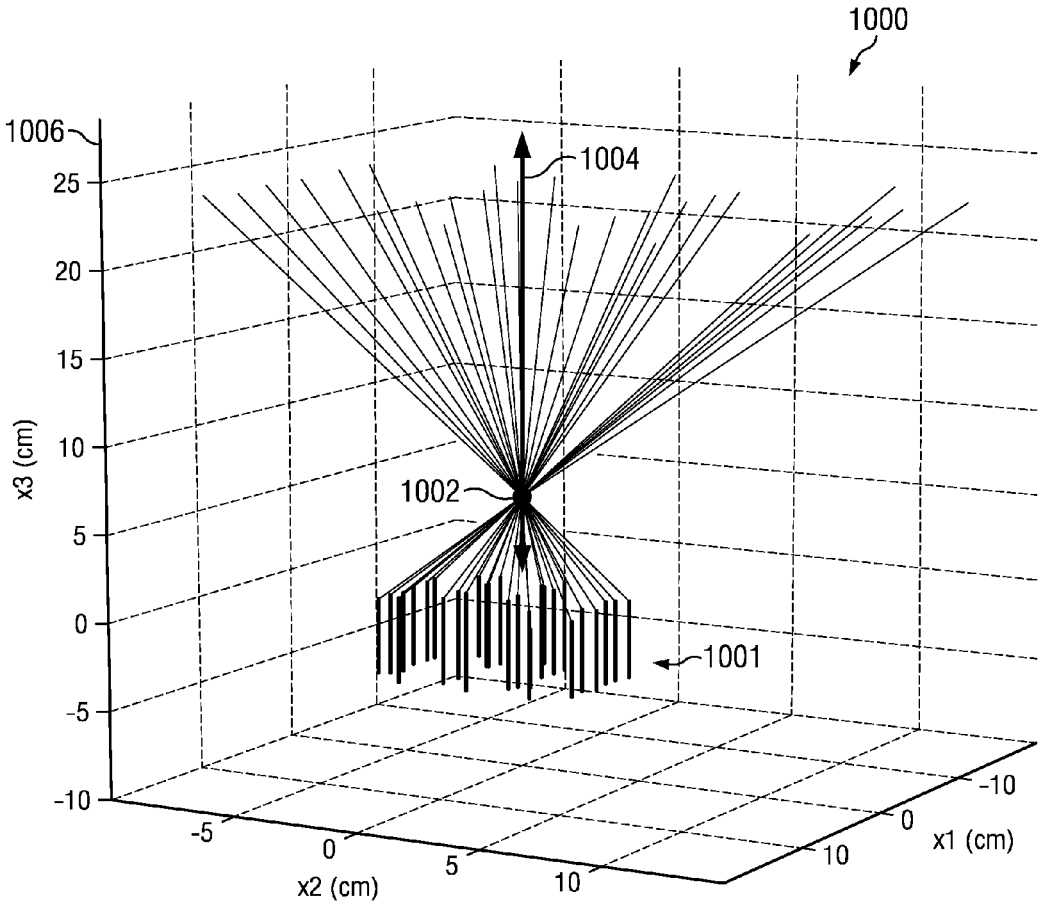
FIG. 10 is an illustration of a graph of radio frequency beams in accordance with an advantageous embodiment.

With reference now to FIG. 10, an illustration of a graph of radio frequency beams is depicted in accordance with an advantageous embodiment. In this illustrative example, graph 1000 is for a simulation of radio frequency beams passing through gradient index lens 900 in FIG. 9. Graph 1000 has lines 1001. Lines 1001 correspond to the radio frequency beams passing through gradient index lens 900.

In this illustrative example, point 1002 corresponds to a focal point of gradient index lens 900. The radio frequency beams may enter gradient index lens 900 at one angle and then exit gradient index lens 900 at another angle. The angle at which the radio frequency beams exit changes, even though the angle at which the radio frequency beam enters remains substantially the same. This change occurs as the location at which the radio frequency beams enter gradient index lens 900 changes. These changes in the angles for the radio frequency beams exiting gradient index lens 900 are depicted by the change in the angles for lines 1001.

Axis 1004 through point 1002 and substantially parallel to vertical axis 1006 of graph 1000 corresponds to optical axis 902 in FIG. 9. The further off from optical axis 902 that the radio frequency beams enter gradient index lens 900, the further away from optical axis 902 are the angles at which the radio frequency beams exit gradient index lens 900.

Figure 11:
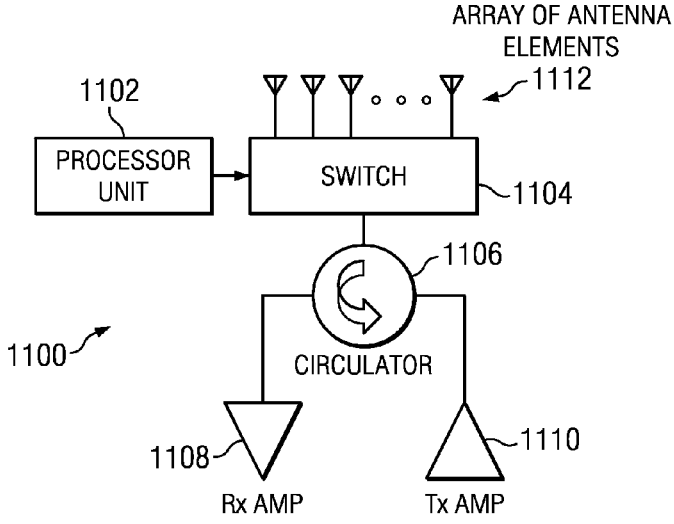
FIG. 11 is an illustration of a portion of an antenna controller in accordance with an advantageous embodiment.

With reference now to FIG. 11, an illustration of a portion of an antenna controller is depicted in accordance with an advantageous embodiment. In this illustration, antenna controller 1100 is an example of one implementation for antenna controller 118 in FIG. 1.

In this illustrative example, antenna controller 1100 includes processor unit 1102, switch 1104, circulator 1106, receiver amplifier 1108, and transmitter amplifier 1110. Switch 1104 is connected to array of antenna elements 1112. Processor unit 1102 may control switch 1104 to select a number of antenna elements from array of antenna elements 1112 to transmit a radio frequency beam using transmitter amplifier 1110. Transmitter amplifier 1110 amplifies a signal for transmission as a radio frequency beam. Circulator 1106 provides a separation between the radio frequency beams transmitted by transmitter amplifier 1110 and received by receiver amplifier 1108.

Switch 1104 also may receive signals detected by array of antenna elements 1112 and send those detected signals to receiver amplifier 1108. Receiver amplifier 1108 amplifies those signals for processing.

In these illustrative examples, processor unit 1102 may control switch 1104 to select a single element in array of antenna elements 1112. Alternatively, processor unit 1102 may control switch 1104 to select two or more antenna elements. In this manner, different size beams and/or different numbers of beams may be generated by array of antenna elements 1112. In a similar fashion, different numbers of antenna elements may be activated to detect or receive radio frequency beams.

With respect to FIGS. 12-26, illustrations involving the design of a negative index metamaterial lens are depicted in accordance with an advantageous embodiment. In particular, FIGS. 12-26 may be illustrations involving the design of metamaterial lens 124 in FIG. 1 and/or lens 122 in FIG. 1.

In these examples, the negative index metamaterial lens has a buckyball shape. The lens is designed to match the material properties in the θ and ϕ directions in a manner that may preserve the circular polarization of a beam generated by an antenna element. In these examples, a beam having a 60 degree angle may be steered to a substantially horizontal direction. The negative index metamaterial lens may be designed to map beams from about zero degrees to about 38 degrees to beams from about zero degrees to about 90 degrees. In other words, a beam with about 38 degrees may be redirected to about 90 degrees, which is about horizontal.

A negative index metamaterial lens may have a number of different forms. In some advantageous embodiments, a negative index metamaterial lens is designed based on two curves, such as parabolas.

Figure 12:
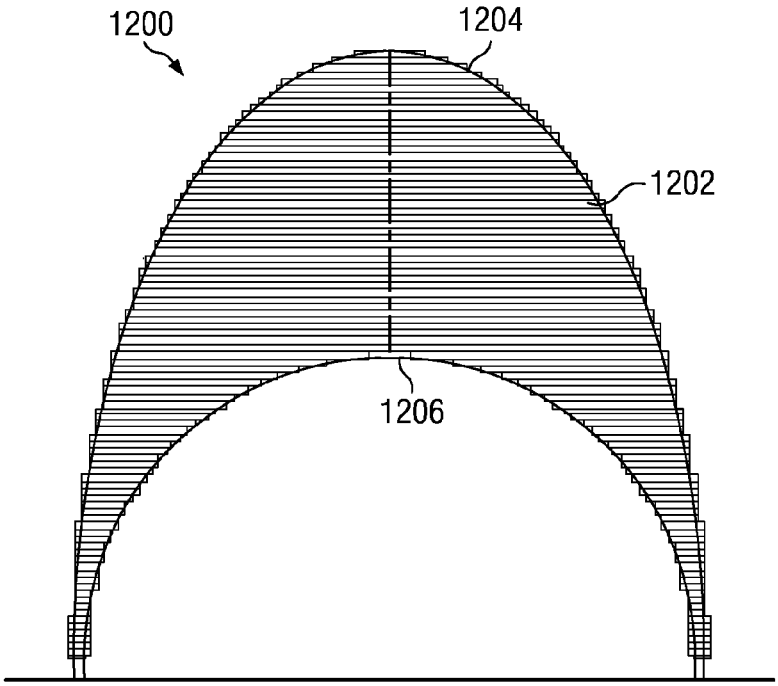
FIG. 12 is an illustration of a negative index metamaterial lens in accordance with an advantageous embodiment.

Turning now to FIG. 12, an example of a negative index metamaterial lens is depicted in accordance with an advantageous embodiment. In this example, lens 1200 is an example of an index metamaterial lens that may be used with antenna system 110.

In this example, lens 1200 includes negative index metamaterial unit cells 1202 between ellipse 1204 and ellipse 1206. Negative index metamaterial unit cells 1202 form the material for lens 1200. In these illustrative examples, negative index metamaterial unit cells 1202 are placed between ellipse 1204 and ellipse 1206 in layers. In these illustrative examples, ellipse 1204 and ellipse 1206 are only outlines of boundaries for lens 1200. These ellipses are not actually part of lens 1200.

The layers containing negative index metamaterial unit cells 1202 are aligned with other layers of these unit cells to maintain a crystalline stacking. Crystalline stacking occurs when the unit cell boundaries of one layer are aligned with unit cell boundaries in another layer. Non-crystalline stacking occurs if the boundaries between unit cells' different layers are not aligned. The height of each layer is one unit cell thick, while the width of each layer may be a number of unit cells or a single unit cell designed to the appropriate size.

Figure 13:
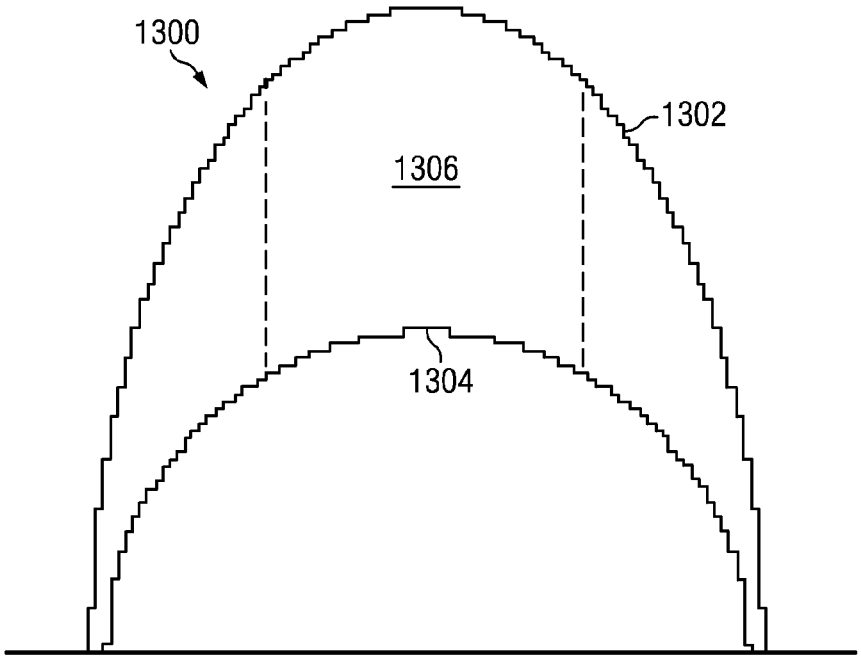
FIG. 13 is an illustration of an outline of a negative index metamaterial lens in accordance with an advantageous embodiment.

Turning now to FIG. 13, an illustration of an outline of a negative index metamaterial lens is depicted in accordance with an advantageous embodiment. Lens outline 1300 is an outline of a negative index metamaterial lens, such as lens 1200 in FIG. 12.

In this example, lens outline 1300 results from the placement of negative index metamaterial cells between ellipses 1204 and 1206 in FIG. 12. Lens outline 1300 has outer edge 1302 and inner edge 1304. Lens outline 1300 has a discrete or jagged look. In actual implementation, this design may be rotated 360 degrees to form a three-dimensional design for a negative index metamaterial lens.

Additionally, lens outline 1300 may have a portion removed, such as a portion within section 1306, to reduce weight and interference for directions in which additional bending of a beam is unnecessary.

Figure 14:
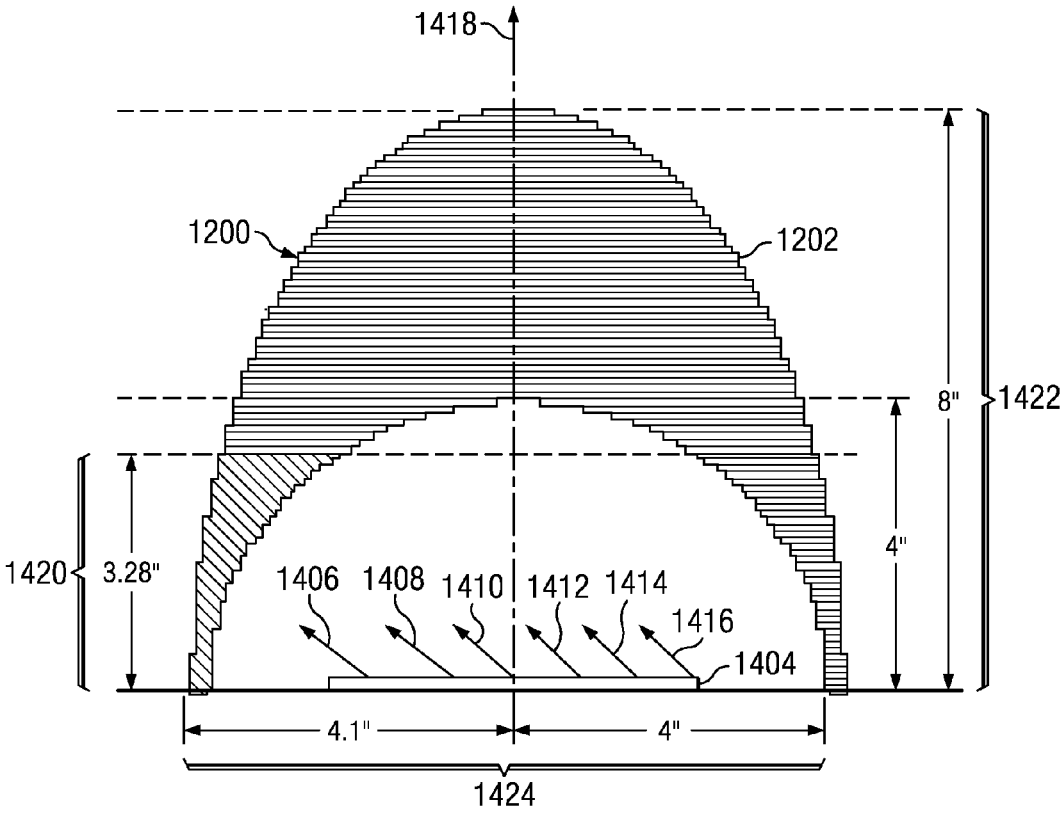
FIG. 14 is an illustration of a cross-section of a lens in relation to an array for an antenna system in accordance with an advantageous embodiment.

With reference now to FIG. 14, an illustration of a cross section of a lens in relation to an array for an antenna system is depicted in accordance with an advantageous embodiment. In this example, lens 1200 is shown with respect to array 1404. Array 1404 is an array of radio frequency emitters. In particular, array 1404 may emit radio frequency signals in the form of microwave transmissions.

Array 1404 may emit radio frequency emissions 1406, 1408, 1410, 1412, 1414, and 1416 to form a beam that may be transmitted at an angle of about 60 degrees with respect to normal vector 1418.

Lens 1200 is designed, in this example, with the inner ellipse having a circle of about 4 inches, an outer ellipse having a semi-major axis of about 8 inches, and a semi-minor axis of about 4.1 inches. In this example, lens 1200 may be designed to only include a portion of lens 1200 within section 1420. In this example, lens 1200 may have a height of about 8 inches, as shown in section 1422. Lens 1200 may have a width of about 8.1 inches, as shown in section 1424.

Of course, the illustration of lens 1200 in FIG. 14 is shown as a two-dimensional cross section of a negative index metamaterial lens.

Figure 15:
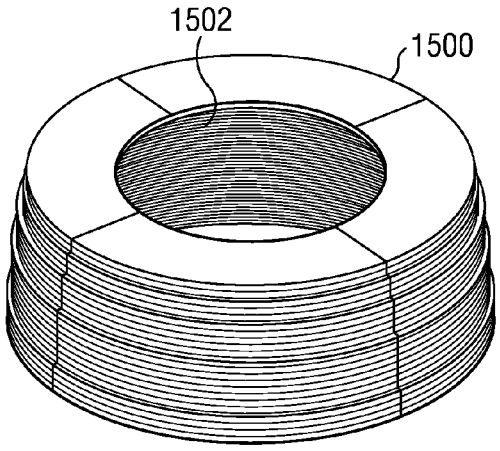
FIG. 15 is an illustration of a lens in accordance with an advantageous embodiment.

Turning now to FIG. 15, an illustration of a lens is depicted in accordance with an advantageous embodiment. In this illustrative example, lens 1500 is presented in a perspective view. Lens 1500 is the portion of lens 1200 in section 1420 in FIG. 14. In this example, the array of antenna elements is located within channel 1502 of lens 1500. In this example, the array is not visible.

Figure 16:
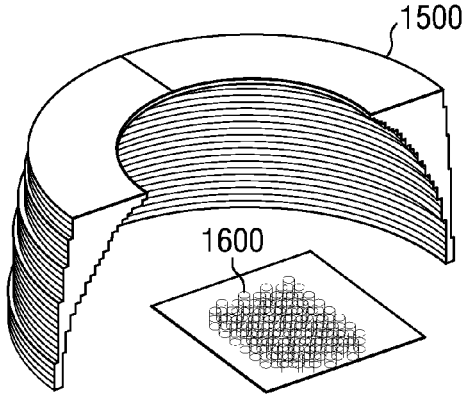
FIG. 16 is an illustration of a cross-sectional perspective view of a lens in accordance with an advantageous embodiment.

With reference now to FIG. 16, an illustration of a cross-sectional perspective view of lens 1500 in FIG. 15 is depicted in accordance with an advantageous embodiment. In this example, array 1600 is an example of array of antenna elements 116 in FIG. 1. Lens 1500 is located over array 1600. Lens 1500 is an example of the implementation for lens 122 in FIG. 1. This cross-sectional perspective view is presented to show a perspective view of array 1600 with a portion of lens 1500.

Figure 17:
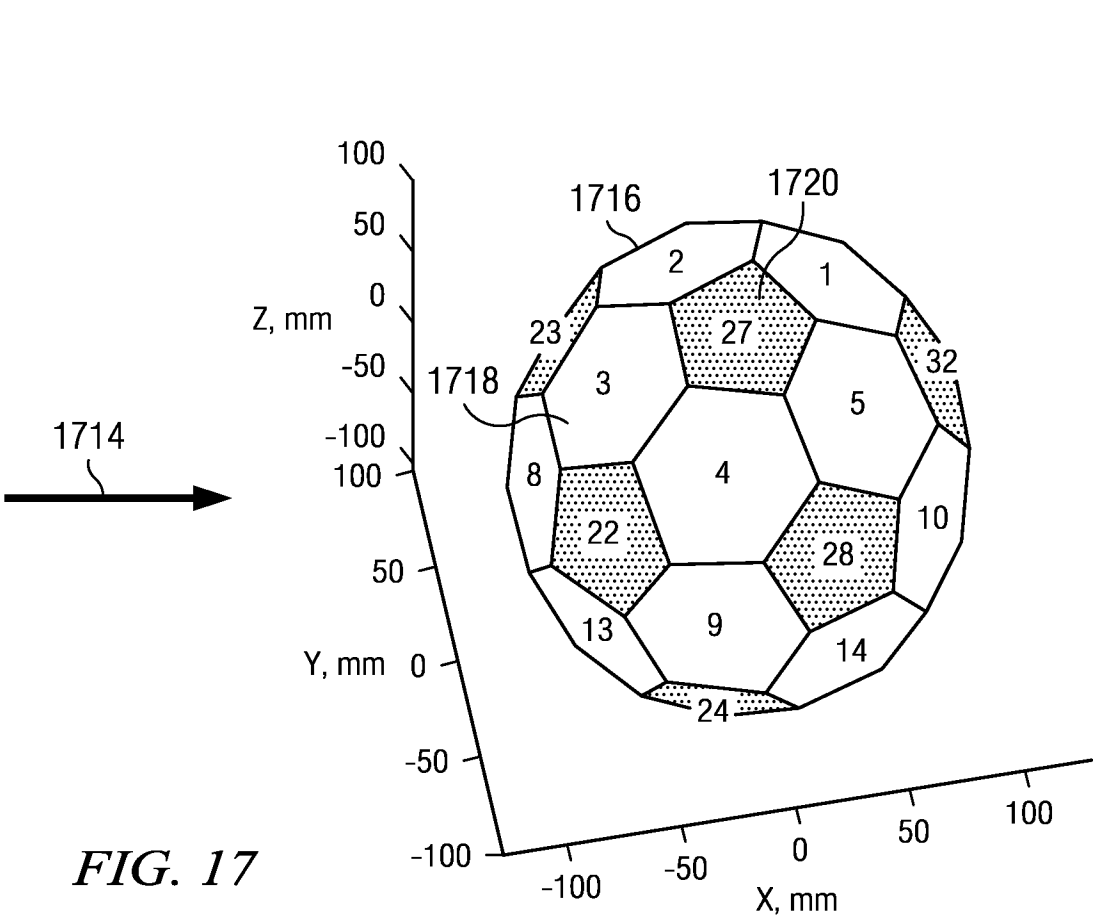
FIG. 17 is an illustration of a lens design in accordance with an advantageous embodiment.
Figure 17:
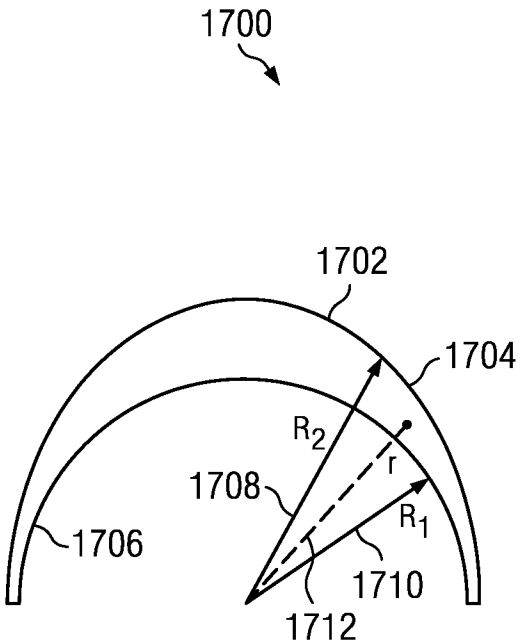

With reference now to FIG. 17, an illustration of a lens design is depicted in accordance with an advantageous embodiment. In this example, lens shape 1700 is a truncated icosahedron. Lens shape 1700 also may be referred to as a buckyball shape. Although lens shape 1700 is shown as an entire or complete buckyball, the buckyball shape for lens 1700 may be a portion of a buckyball. In other words, the buckyball shape for lens shape 1700 may not be an entire "ball".

In the different advantageous embodiments, lens design 1702 is an example of the lens design for lens 302 in FIG. 3.

In these illustrative examples, lens design 1702 is an example of a design that may be used to implement negative index metamaterial lens 135 in FIG. 1. As illustrated, lens design 1702 contains ellipse 1704 and ellipse 1706. Ellipse 1704 has radius 1708, while ellipse 1706 has radius 1710. Ellipse 1704 may be referred to as an outer ellipse, while ellipse 1706 may be referred to as an inner ellipse. Radius 1708 may be an outer radius, while radius 1710 may be an inner radius for lens design 1702. Radius 1712 may be any value between radius 1708 and radius 1710.

Lens design 1702 may be turned into lens shape 1700 in these illustrative examples. In this illustrative example, shell 1716 of lens shape 1700 may be selected to have an average radius roughly equal to radius 1712 of lens design 1702.

Shell 1716 of lens shape 1700 has two types of faces in these examples. These faces include, for example, hexagonal face 1718 and pentagonal face 1720. In this depicted example, each face on shell 1716 may be given an initial thickness for discrete components, such as elements formed from unit cell assemblies in a radial direction. This initial thickness may be, for example, six unit cell assemblies thick. Of course, other thicknesses may be selected in other embodiments.

The thickness of each face may be selected by taking into consideration unit cell index of refraction range availability and losses. With a thicker face, the particular face has more capability to bend radio frequency signals in the form of a beam. Further, less extreme values of an index of refraction also may be used with a thicker face. A face is a loss medium with respect to the transmission of a beam through a face. Thus, a thicker face may result in increased losses as compared to a thinner face. In other words, more losses may occur in the beam, because the beam travels a longer distance through the thicker face as compared to a thinner face.

For each face on shell 1716, conformal transformation 1714 is performed to transform lens design 1702 into lens shape 1700. Conformal transformation 1714 may be performed using commonly available conformal transformation processes and/or algorithms. Conformal transformation 1714 is an angle preserving transformation and also may be referred to as conformal mapping. Conformal transformation 1714 is used to transform or map one geometry to another geometry. In these illustrative examples, conformal transformation 1714 may be performed for points on each face on shell 1716.

After the conformal transformation is performed, a new index of refraction is identified for lens shape 1700. If the new index of refraction is within the unit cell design range and losses are acceptable, the design of lens shape 1700 is complete. If the index of refraction for the points on any of the faces in shell 1716 is outside of the unit cell design range, then the unit cell type may be changed, or a different thickness may be chosen for that face.

Alternatively, the thickness for each face also may be changed. The thickness of each face also may be changed, depending on the losses. In the illustrative examples, losses come from resistive and/or dielectric losses inside the unit cell. In these illustrative examples, a loss may be considered acceptable if the total loss through the thickness of a face is less than about three decibels. Of course, depending on the particular implementation, higher loss levels may be selected as a threshold for an acceptable amount of loss. Also, in some advantageous embodiments, the transmit power of the array may be increased to compensate for the losses and signal attenuation that may occur.

With lens shape 1700, a full dome coverage may be provided for a phased array in a manner that may avoid edge discontinuity that may occur with lens 302 in FIG. 3.

Figure 18:
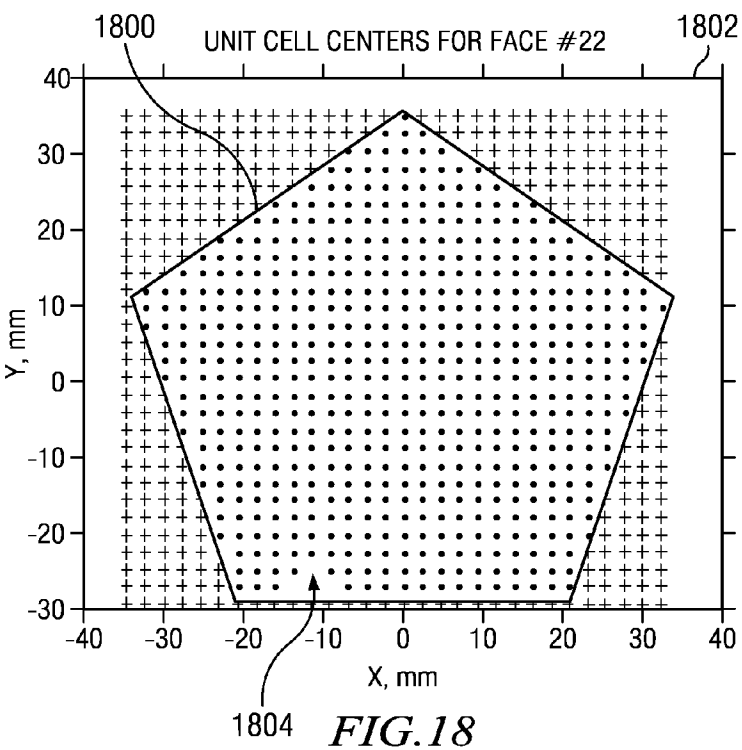
FIG. 18 is an illustration of a face of a buckyball shell in accordance with an advantageous embodiment.

With reference now to FIG. 18, an illustration of a face of a buckyball shell is depicted in accordance with an advantageous embodiment. Face 1800 is an example of pentagonal face 1720 on shell 1716 in FIG. 17. Face 1800 is shown within graph 1802 in which the x-axis is in millimeters, and the y-axis is in millimeters. Points 1804 within face 1800 are points in which conformal transformation may be performed from lens design 1702 using conformal transformation 1714 to obtain lens shape 1700 in FIG. 17. The conformal transformation is performed through each point within points 1804 in face 1800. Each point in points 1804 may have a slightly different refractive index value.

Figure 19:
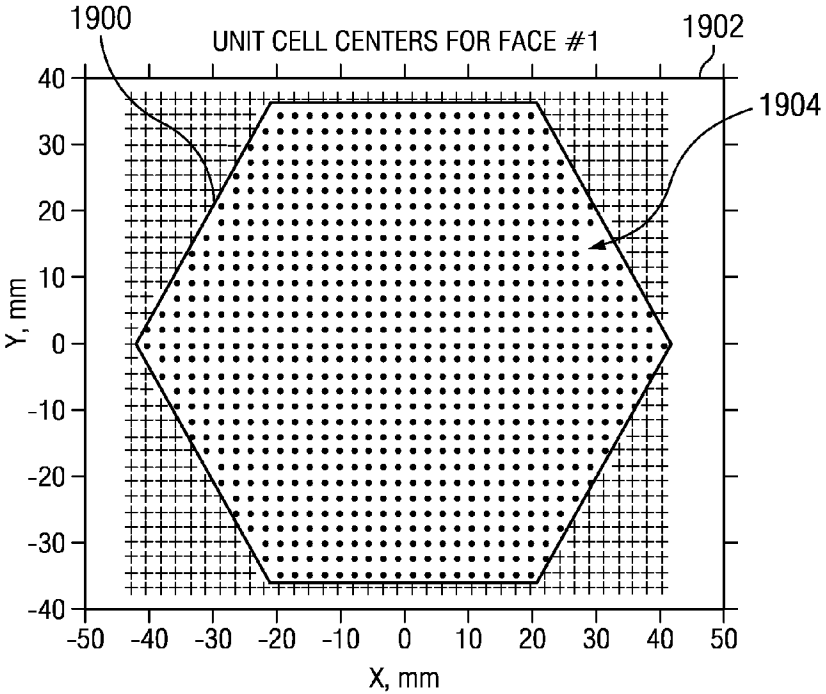
FIG. 19 is an illustration of a face in a buckyball shell in accordance with an advantageous embodiment.

With reference now to FIG. 19, an illustration of a face in a buckyball shell is depicted in accordance with an advantageous embodiment. In this example, face 1900 is an example of hexagonal face 1718 on shell 1716 in FIG. 17. Face 1900 is shown within graph 1902 in which the x-axis is in millimeters, and the y-axis is in millimeters. A conformal transformation is performed for each point within points 1904 to map lens design 1702 to shell 1716 in FIG. 17.

Points 1904 within face 1900 are points on which conformal transformations are performed in this example. The number of points may be determined by the size of the unit cell assemblies. The distance between the points is the length of the unit cell assembly, which may be about 2.31 millimeters in this illustrative example. A uniform grid with a spacing of about 2.31 millimeters by about 2.31 millimeters is overlaid on top of a face. Points inside the face are included in the transformation. These points represent the center location of the unit cell assemblies.

Figure 20:
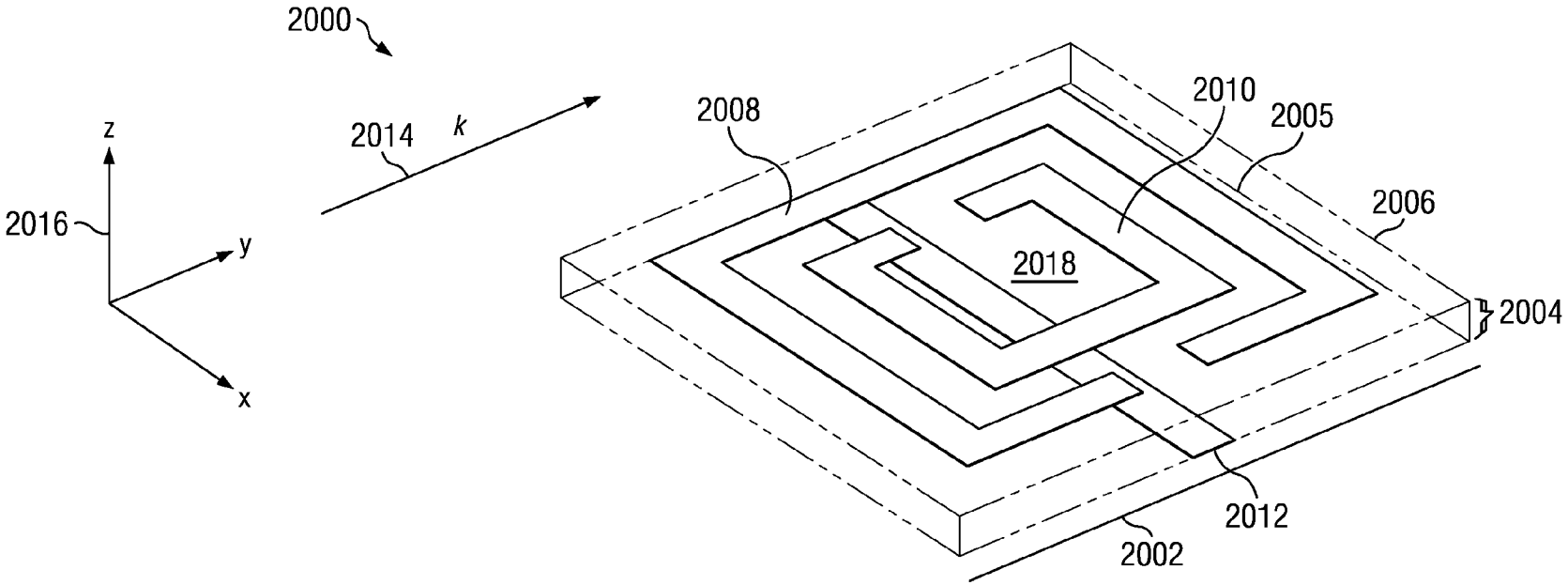
FIG. 20 is an illustration of a cell in accordance with an advantageous embodiment.

With reference now to FIG. 20, an illustration of a cell is depicted in accordance with an advantageous embodiment. In this example, cell 2000 is an example of a negative index metamaterial unit cell that may be used to form a lens, such as lens 122 and/or negative index metamaterial lens 135 in FIG. 1. As depicted, cell 2000 is square shaped. Cell 2000 has length 2002 along each of the sides and height 2004. In these examples, length 2002 may be, for example, about 2.3 millimeters. Height 2004 may be the height of the substrate. For example, the height may be about 25 millimeters. These dimensions may vary, depending on the particular implementation. Cell 2000 comprises substrate 2006.

Substrate 2006 provides support for copper rings and wire traces, such as split ring resonator 2005, which includes traces 2008 and 2010. Additionally, substrate 2006 also may contain trace 2012. In these examples, substrate 2006 may have a low dielectric loss tangent to reduce the overall loss of the unit cell. In these examples, substrate 2006 may be, for example, alumina. Another example of a substrate that may be used is an RT/Duroid® 5870 high frequency laminate. This type of substrate may be available from Rogers Corporation. Of course, any type of material may be used for substrate 2006 to provide a mechanical carrier of structure for the arrangement and design of the different traces to achieve the desired E and H fields.

Split ring resonator 2005 is used to provide some of the properties to generate a negative index of refraction for cell 2000. Traces 2008 and 2010 provide negative permeability for a magnetic response. Split ring resonator 2005 creates a negative permeability caused by the reaction of the pattern of these traces to energy. Trace 2012 also provides for negative permittivity.

In this example, wave propagation vector k 2014 is in the y direction, as indicated by reference axis 2016. Split ring resonator 2005 couples the Hz component to provide negative permeability in the z direction. Trace 2012 is a wire that couples the Ex component providing negative permittivity in the x direction by stacking cell 2000 with cells in other planes. Coupling of other E and H field components may be achieved.

Although a particular pattern is shown for split ring resonator 2005, other types of patterns may be used. For example, the patterns may be circular, rather than square in shape for split ring resonator 2005. Various parameters may be changed in split ring resonator 2005 to change the permeability of the structure. For example, the orientation of split ring resonator 2005, with respect to trace 2012, can change the magnetic permeability of cell 2000.

As another example, the width of the loop formed by trace 2008, the width of the inner loop formed by trace 2010, the use of additional paramagnetic materials within area 2018, and a type of pattern as well as other changes in the features of cell 2000 may change the permeability of cell 2000. The permittivity of cell 2000 also may be changed by altering various components, such as the material for trace 2012, the width of trace 2012, and the distance of trace 2012 from split ring resonator 2005.

Figure 21:
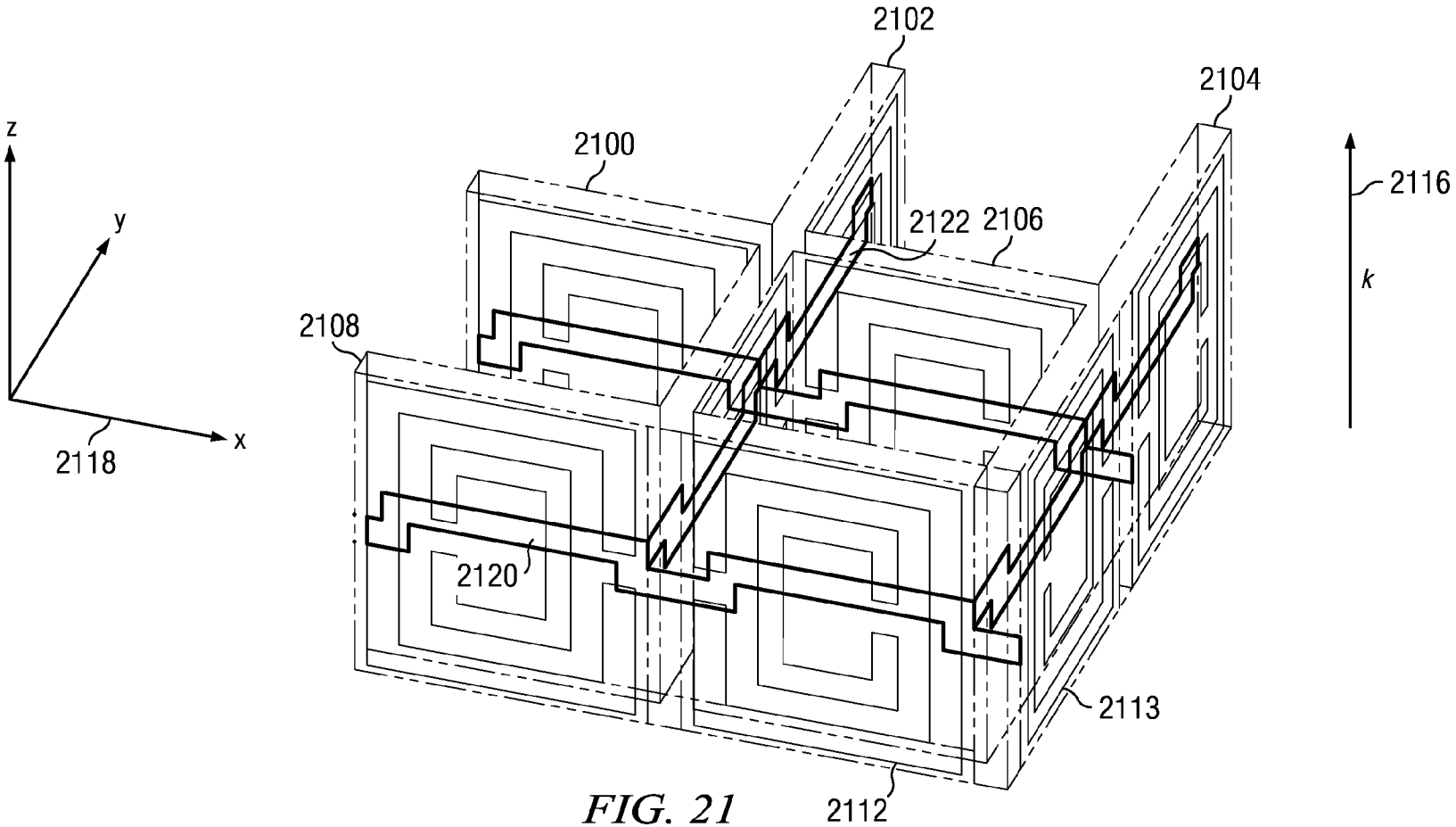
FIG. 21 is an illustration of a unit cell arrangement in accordance with an advantageous embodiment.

With reference now to FIG. 21, an illustration of a unit cell arrangement is depicted in accordance with an advantageous embodiment. In this example, unit cells 2100, 2102, 2104, 2106, 2108, 2112, and 2113 are depicted. These unit cells are similar to cell 2000 in FIG. 20.

In this example, wave vector k 2116 is in the z direction with reference to axis 2118. Permittivity and permeability are negative both in the x and y directions with this type of architecture. A notch, such as notch 2120 and notch 2122, is present in the y wires so that they do not cross each other in these examples. To avoid wire intersections, routing notches are included at the cell boundary. The notches and the stacking of cells are shown in more detail with respect to FIGS. 22 and 23 below.

Figure 22:
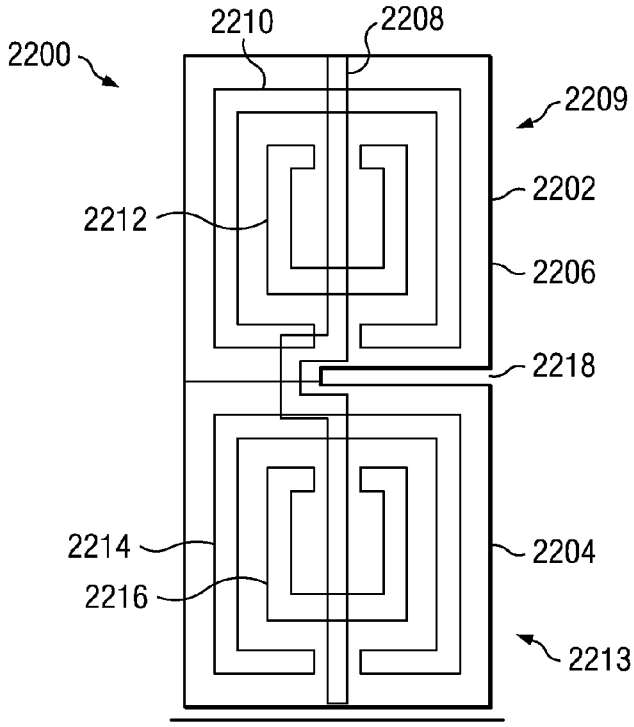
FIG. 22 is an illustration of two unit cells in accordance with an advantageous embodiment.

With reference now to FIG. 22, an illustration of two unit cells is depicted in accordance with an advantageous embodiment. In this example, element 2200 includes unit cell 2202 and unit cell 2204 formed in substrate 2206.

Wire trace 2208 runs through both unit cells 2202 and 2204. Unit cell 2202 has split ring resonator 2209 formed by traces 2210 and 2212. Unit cell 2204 has split ring resonator 2213 formed by traces 2214 and 2216. As can be seen in this illustration, element 2200 has notch 2218 between unit cells 2202 and 2204 to allow for perpendicular stacking and/or assembly.

Figure 23:
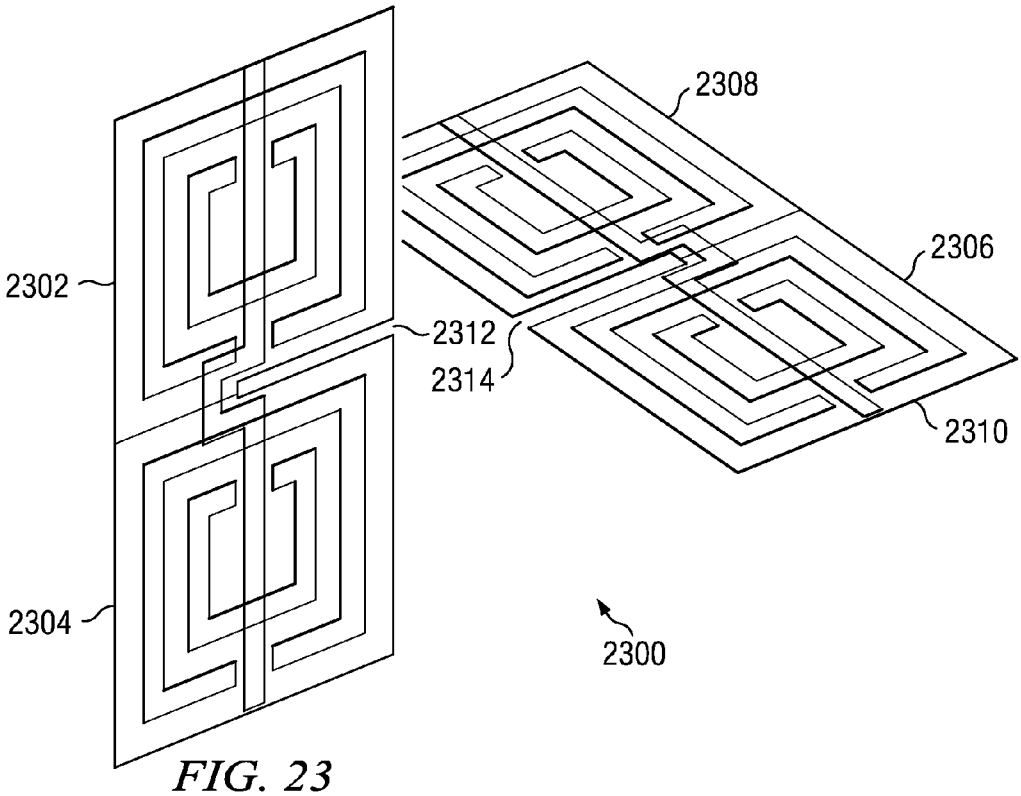
FIG. 23 is an illustration of unit cells positioned for assembly in accordance with an advantageous embodiment.

With reference now FIG. 23, an illustration of unit cells positioned for assembly is depicted in accordance with an advantageous embodiment. In this example, element 2300 includes unit cells 2302 and 2304. Element 2306 contains unit cells 2308 and 2310. As can be seen, notches 2312 and 2314 are present in elements 2300 and 2306. Elements 2300 and 2306 are positioned to allow engagement for assembly for these two elements at notches 2312 and 2314. These elements are also referred to as unit cell assemblies.

Figures 24, 25:
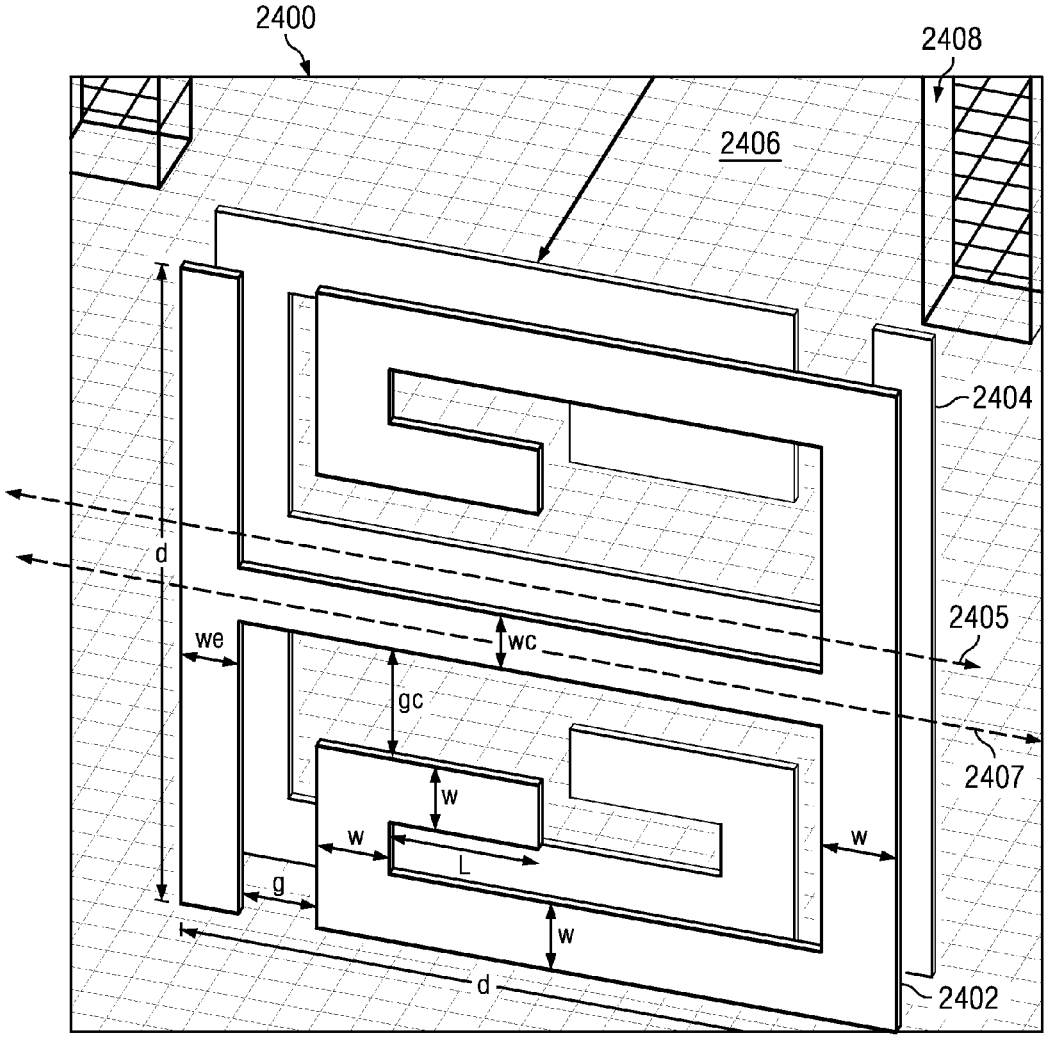
FIG. 24 is an illustration of a unit cell in accordance with an advantageous embodiment.
FIG. 25 is an illustration of a table illustrating dimensions for a cell in accordance with an advantageous embodiment.

With reference now to FIG. 24, an illustration of a unit cell is depicted in accordance with an advantageous embodiment. In this example, unit cell 2400 has trace 2402 and trace 2404. Traces 2402 and 2404 may be symmetric about center lines 2405 and 2407 of traces 2402 and 2404, respectively. In other words, trace 2402 may be located substantially between surfaces 2406 and 2408. Trace 2404 may be located on surface 2406. Trace 2404 may have an identical pattern to trace 2402 but may be rotated about 260 degrees around an axis normal to surfaces 2406 and 2408.

Turning to FIG. 25, an illustration of a table illustrating dimensions for a cell is depicted in accordance with an advantageous embodiment. Table 2500 illustrates dimensions for trace 2402 and trace 2404 in unit cell 2400 in FIG. 24. These dimensions are in millimeters.

Figure 26:
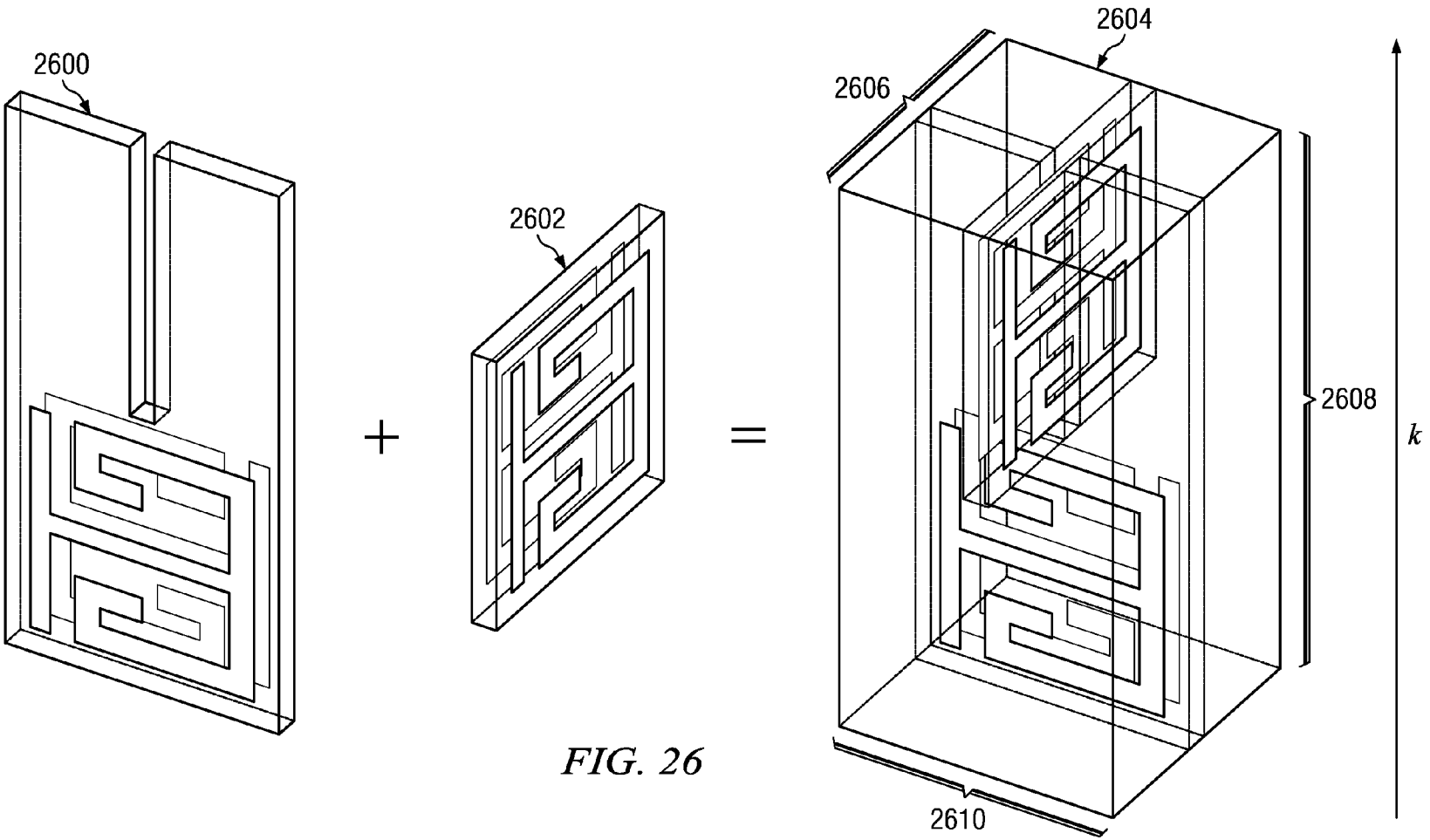
FIG. 26 is an illustration of a unit cell assembly in accordance with an advantageous embodiment.

With reference now to FIG. 26, an illustration of a unit cell assembly is depicted in accordance with an advantageous embodiment. In this example, unit cell 2600 contains traces similar to those for cell 2400 in FIG. 24. Cell 2602 also contains trace patterns similar to unit cell 2400. Cell 2600 and cell 2602 may be assembled to form element 2604, which is a unit cell assembly.

Element 2604 may be a discrete component for a lens. In this example, element 2604 has width 2606, thickness 2608, and length 2610. Thickness 2608 is a thickness of this element. Thickness 2608 is in the direction of the wave propagation, wave propagation vector k.

The illustration of the different unit cell designs and assemblies are not meant to imply architectural or physical limitations to the manner in which different unit cells may be assembled to form discrete components for different cell designs. Other designs for cells and other types of assemblies may be employed, depending on the particular implementation.

Figure 27:
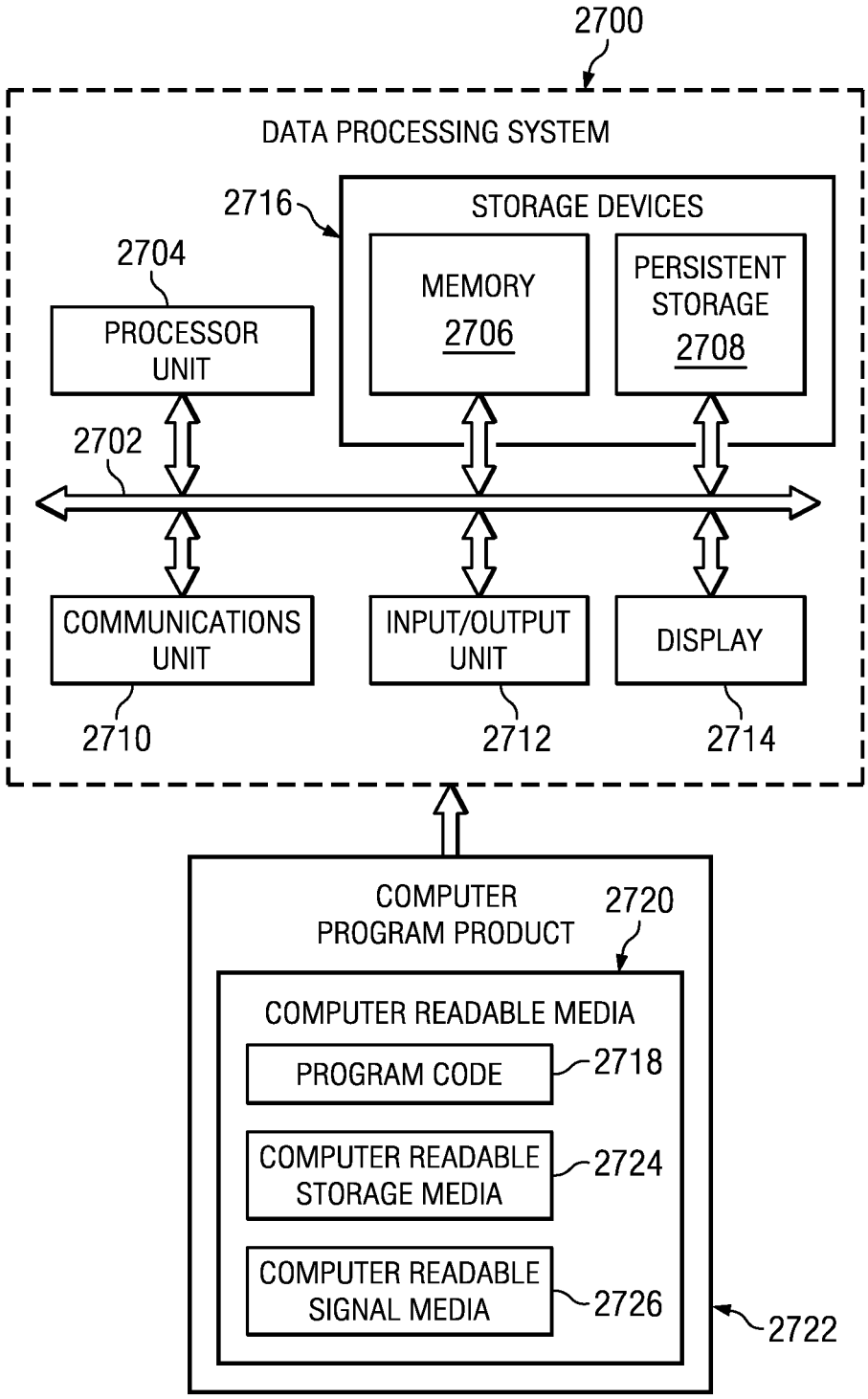
FIG. 27 is an illustration of a data processing system in accordance with an advantageous embodiment.

Turning now to FIG. 27, an illustration of a data processing system is depicted in accordance with an advantageous embodiment. In this illustrative example, data processing system 2700 includes communications fabric 2702, which provides communications between processor unit 2704, memory 2706, persistent storage 2708, communications unit 2710, input/output (I/O) unit 2712, and display 2714.

Processor unit 2704 serves to execute instructions for software that may be loaded into memory 2706. Processor unit 2704 may be a set of one or more processors or may be a multi-processor core, depending on the particular implementation. Further, processor unit 2704 may be implemented using one or more heterogeneous processor systems, in which a main processor is present with secondary processors on a single chip. As another illustrative example, processor unit 2704 may be a symmetric multi-processor system containing multiple processors of the same type.

Memory 2706 and persistent storage 2708 are examples of storage devices 2716. A storage device is any piece of hardware that is capable of storing information, such as, for example, without limitation, data, program code in functional form, and/or other suitable information either on a temporary basis and/or a permanent basis. Memory 2706, in these examples, may be, for example, a random access memory or any other suitable volatile or non-volatile storage device. Persistent storage 2708 may take various forms, depending on the particular implementation. For example, persistent storage 2708 may contain one or more components or devices. For example, persistent storage 2708 may be a hard drive, a flash memory, a rewritable optical disk, a rewritable magnetic tape, or some combination of the above. The media used by persistent storage 2708 may be removable. For example, a removable hard drive may be used for persistent storage 2708.

Communications unit 2710, in these examples, provides for communication with other data processing systems or devices. In these examples, communications unit 2710 is a network interface card. Communications unit 2710 may provide communications through the use of either or both physical and wireless communications links.

Input/output unit 2712 allows for the input and output of data with other devices that may be connected to data processing system 2700. For example, input/output unit 2712 may provide a connection for user input through a keyboard, a mouse, and/or some other suitable input device. Further, input/output unit 2712 may send output to a printer. Display 2714 provides a mechanism to display information to a user.

Instructions for the operating system, applications, and/or programs may be located in storage devices 2716, which are in communication with processor unit 2704 through communications fabric 2702. In these illustrative examples, the instructions are in a functional form on persistent storage 2708. These instructions may be loaded into memory 2706 for execution by processor unit 2704. The processes of the different embodiments may be performed by processor unit 2704 using computer implemented instructions, which may be located in a memory, such as memory 2706.

These instructions are referred to as program code, computer usable program code, or computer readable program code that may be read and executed by a processor in processor unit 2704. The program code in the different embodiments may be embodied on different physical or computer readable storage media, such as memory 2706 or persistent storage 2708.

Program code 2718 is located in a functional form on computer readable media 2720 that is selectively removable and may be loaded onto or transferred to data processing system 2700 for execution by processor unit 2704. Program code 2718 and computer readable media 2720 form computer program product 2722. In one example, computer readable media 2720 may be computer readable storage media 2724 or computer readable signal media 2726. Computer readable storage media 2724 may include, for example, an optical or magnetic disk that is inserted or placed into a drive or other device that is part of persistent storage 2708 for transfer onto a storage device, such as a hard drive, that is part of persistent storage 2708. Computer readable storage media 2724 also may take the form of a persistent storage, such as a hard drive, a thumb drive, or a flash memory that is connected to data processing system 2700. In some instances, computer readable storage media 2724 may not be removable from data processing system 2700.

Alternatively, program code 2718 may be transferred to data processing system 2700 using computer readable signal media 2726. Computer readable signal media 2726 may be, for example, a propagated data signal containing program code 2718. For example, computer readable signal media 2726 may be an electromagnetic signal, an optical signal, and/or any other suitable type of signal. These signals may be transmitted over communications links, such as wireless communications links, an optical fiber cable, a coaxial cable, a wire, and/or any other suitable type of communications link. In other words, the communications link and/or the connection may be physical or wireless in the illustrative examples.

In some illustrative embodiments, program code 2718 may be downloaded over a network to persistent storage 2708 from another device or data processing system through computer readable signal media 2726 for use within data processing system 2700. For instance, program code stored in a computer readable storage media in a server data processing system may be downloaded over a network from the server to data processing system 2700. The data processing system providing program code 2718 may be a server computer, a client computer, or some other device capable of storing and transmitting program code 2718.

The different components illustrated for data processing system 2700 are not meant to provide architectural limitations to the manner in which different embodiments may be implemented. The different advantageous embodiments may be implemented in a data processing system including components in addition to or in place of those illustrated for data processing system 2700. Other components shown in FIG. 27 can be varied from the illustrative examples shown. The different embodiments may be implemented using any hardware device or system capable of executing program code. As one example, data processing system 2700 may include organic components integrated with inorganic components and/or may be comprised entirely of organic components excluding a human being. For example, a storage device may be comprised of an organic semiconductor.

As another example, a storage device in data processing system 2700 is any hardware apparatus that may store data. Memory 2706, persistent storage 2708, and computer readable media 2720 are examples of storage devices in a tangible form.

In another example, a bus system may be used to implement communications fabric 2702 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 2706 or a cache such as found in an interface and memory controller hub that may be present in communications fabric 2702.

Figure 28:
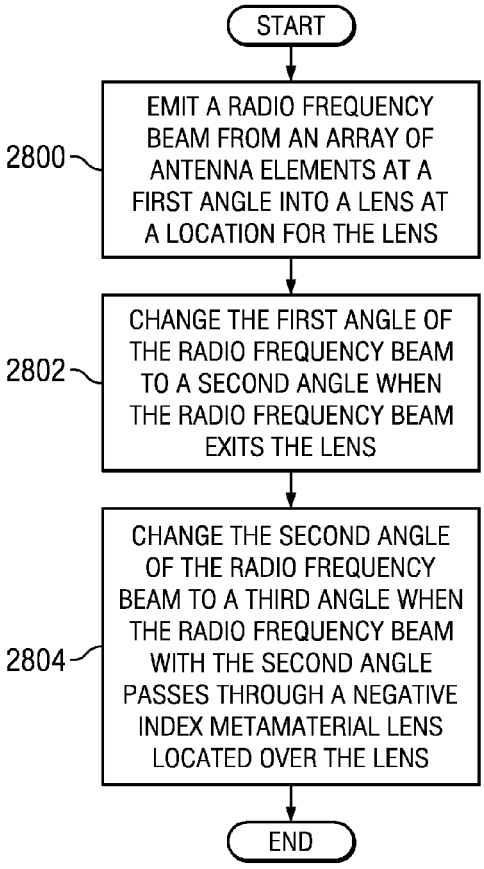
FIG. 28 is an illustration of a flowchart of a process for steering a radio frequency beam in accordance with an advantageous embodiment.

With reference now to FIG. 28, an illustration of a flowchart of a process for steering a radio frequency beam is depicted in accordance with an advantageous embodiment. The process illustrated in FIG. 28 may be implemented in antenna environment 100 using antenna system 110 in FIG. 1.

The process begins by emitting a radio frequency beam from an array of antenna elements at a first angle into a lens at a location for the lens (operation 2800). The process then changes the first angle of the radio frequency beam to a second angle when the radio frequency beam exits the lens (operation 2802). The second angle may change when the location at which the radio frequency beam enters the lens changes.

Thereafter, the process changes the second angle of the radio frequency beam to a third angle when the radio frequency beam with the second angle passes through a negative index metamaterial lens located over the lens (operation 2804), with the process terminating thereafter.

With reference now to FIGS. 29-32, illustrations of processes used in the design of a negative index metamaterial lens are depicted in accordance with an advantageous embodiment. The processes illustrated in FIGS. 29-32 may be used to design and fabricate lens 122 and/or negative index metamaterial lens 135 in FIG. 1 and/or negative index metamaterial lens 300 in FIG. 3.

Figure 29:
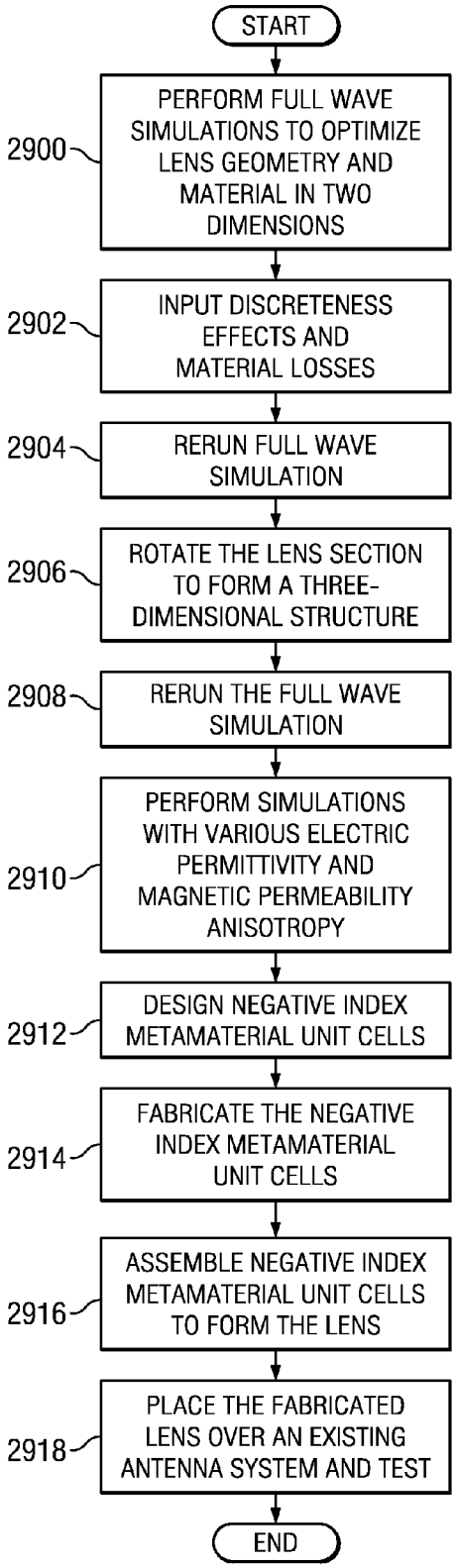
FIG. 29 is an illustration of a flowchart of a process for manufacturing a negative index metamaterial lens for an antenna system in accordance with an advantageous embodiment.

Turning now to FIG. 29, a flowchart of a process for manufacturing a negative index metamaterial lens for an antenna system is depicted in accordance with an advantageous embodiment. In this example, the process may be used to create a lens, such as lens 302 in FIG. 3. The different steps involving design, simulations, and optimizations may be performed using a data processing system, such as data processing system 2700 in FIG. 27.

The process begins by performing full wave simulations to optimize lens geometry and material in two dimensions (operation 2900). In operation 2900, the full wave simulation is a known type of simulation involving Maxwell's equations for electromagnetism. This type of simulation involves solving full wave equations with all the wave effects taken into account. In operation 2900, the lens geometry and the material to bend the beam from about 60 degrees steering to about 90 degrees steering is optimized using the simulations. This 90 degree steering is from horizontal for near horizontal scanning in an antenna system.

Thereafter, the process inputs discreteness effects and material losses (operation 2902). The discreteness takes into account that negative index metamaterial unit cells are used to form the lens. With this type of material, a smooth surface may not be possible. The process then reruns the full wave simulation with the discreteness effects and material losses (operation 2904). This operation confirms that the performance identified in operation 2900 is still at some acceptable level with losses and fabrication limitations.

Thereafter, the lens section is rotated to form a three-dimensional structure (operation 2906). The process then reruns the full wave simulation using the three-dimensional structure (operation 2908). Operation 2908 is used to confirm whether the lens geometry and materials optimized in a two-dimensional model are still valid in a three-dimensional model.

The process then performs simulations with various electric permittivity and magnetic permeability anisotropy (operation 2910). The simulations in operation 2910 are also full wave simulations. The difference in this simulation is that full isotropic materials are used with respect to previous simulations. The simulation in operation 2910 may be run using different levels of anisotropy to determine if reduced materials may be used. This operation may be performed to find reduced materials to make fabrication easier with acceptable or reasonable performance.

A reduced material is an anisotropic material that only couples to E and H fields in one or two selected directions, rather than all three directions like an isotropic material. A reduced material may be desirable because of easier fabrication. For example, rather than stacking unit cells in all three directions, fabrication of cells is easier if only two directions or one direction is used. Next, the negative index metamaterial unit cells are designed (operation 2912). In this example, parameters are identified for a negative index metamaterial unit cell to allow for the operation of the desired frequencies and correct anisotropy.

The process then fabricates the negative index metamaterial unit cells (operation 2914). In operation 2914, the fabrication of the unit cells may be performed using various currently available fabrication processes. These processes may include those used for fabricating semiconductor devices. The process assembles the negative index metamaterial unit cells to form the lens (operation 2916). In this operation, the final lens with the appropriate geometry orientation, material anisotropy, and mechanical integrity is formed. The fabricated lens is then placed over an existing antenna system and tested (operation 2918), with the process terminating thereafter. Operation 2918 confirms whether the lens bends the beam as predicted by the simulations.

Figure 30:
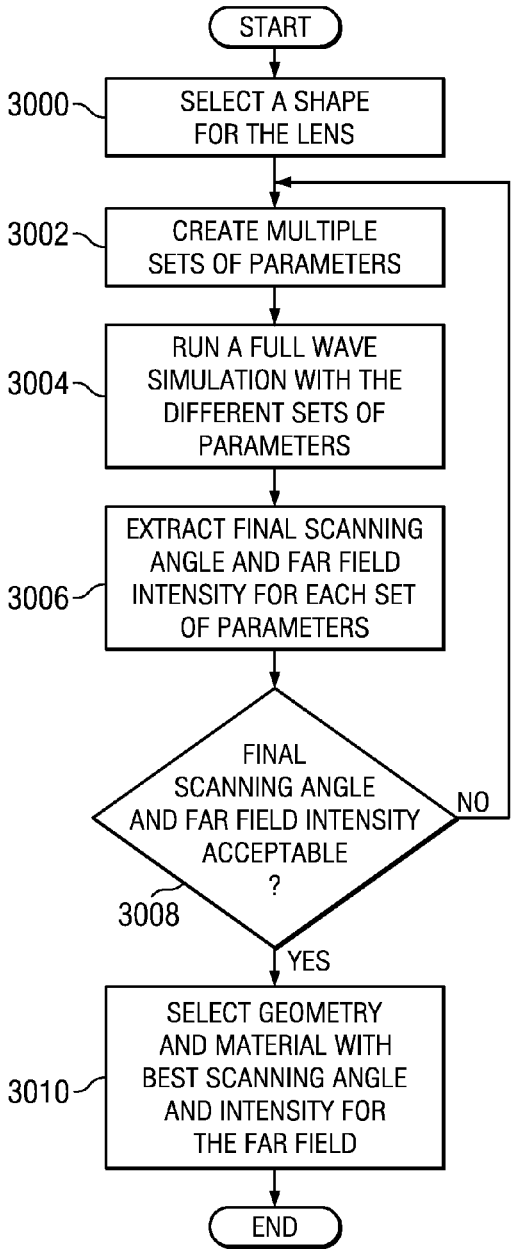
FIG. 30 is an illustration of a flowchart of a process for optimizing a lens design in accordance with an advantageous embodiment.

With reference now to FIG. 30, an illustration of a flowchart of a process for optimizing a lens design is depicted in accordance with an advantageous embodiment. The process illustrated in FIG. 30 is a more detailed explanation of operation 2900 in FIG. 29.

The process begins by selecting a shape for the lens (operation 3000). In these examples, the shape is a pair of ellipses that encompass an area to define a lens. Of course, in other embodiments, other shapes may be selected. Even arbitrary shapes may be selected, depending on the particular implementation. The pair of ellipses includes an inner ellipse with a semi-minor axis, a semi-major axis, and an outer ellipse with a similar axis.

The process creates multiple sets of parameters for the selected shape (operation 3002). In these different sets, various parameters for the shape and material of the lens may be varied. In these examples, the parameters for the semi-major and semi-minor axis may be varied. With this particular example, some constraints may include selecting the semi-minor axis and the semi-major axis of the inner ellipse as being larger than the nominal dimension of the antenna array. Further, the semi-minor axis of the inner ellipse is less than the semi-minor axis of the outer ellipse. Additionally, the semi-major axis of the inner ellipse is always less than the semi-major axis of the outer ellipse.

In the different advantageous embodiments, the semi-minor axis of the inner ellipse may be fixed for the different sets of parameters, while the size and eccentricities of the inner and outer ellipses are varied by changing the other parameters in a range centered about the initial values. Further, the negative index of refraction also may be varied.

The process then runs a full wave simulation with the different sets of parameters (operation 3004). The simulations may be run in two dimensions or three dimensions. With large design spaces, a two-dimensional simulation may be performed for faster results. Based on the two-dimensional results, the optimized lens may be rotated in three dimensions, with the simulations then being rerun in three dimensions to verify the results.

The process then extracts the final scanning angle and far field intensity for each set of parameters (operation 3006). Thereafter, a determination is made as to whether the final scanning angle and far field intensity are acceptable (operation 3008).

If the final scanning angle and far field intensity are acceptable, the process selects a geometry and material with the best scanning angle and intensity for the far field (operation 3010), with the process terminating thereafter. In these examples, this simulation may be run without any discreteness in the ellipses. With reference again to operation 3008, if the final scanning angle and far field intensity are not both acceptable, the process returns to operation 3002. The process then creates additional sets of parameters for testing.

The different simulations performed in operation 3004 include full wave electromagnetic simulations. These simulations may be performed using various available programs. For example, COMSOL Multiphysics version 3.4 is an example of a simulation program that may be used. This program is available from COMSOL AB. This type of simulation simulates the radio frequency transmissions from waveguide elements with a beam pointed in the direction that is desired. Further, the simulation program also simulates the lens with the geometry, materials, and an air box with wave propagation. From these simulations, information about relative far field intensity and final angle of the beam may be identified.

Figure 31:
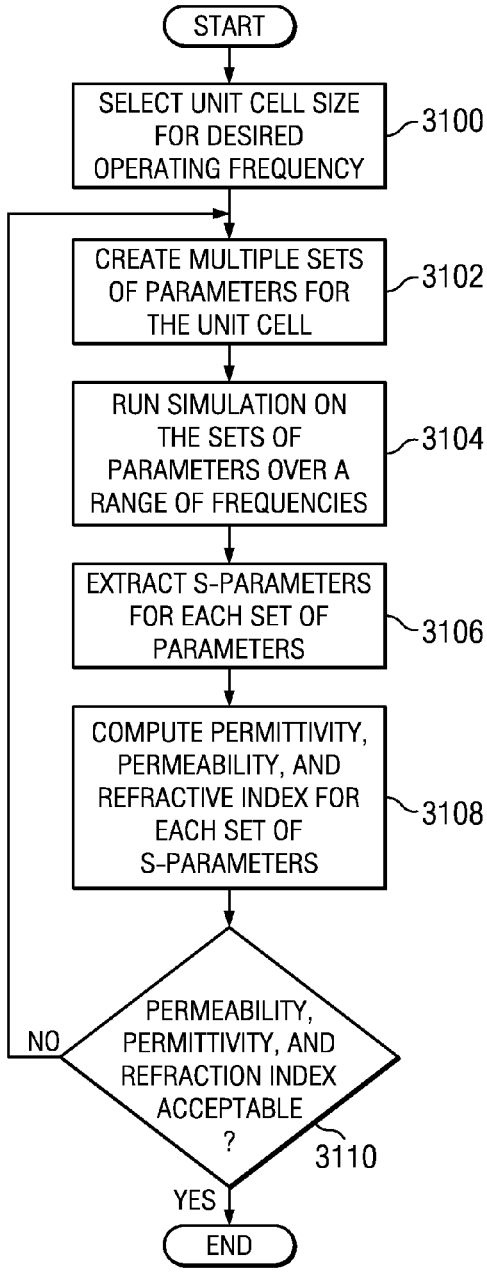
FIG. 31 is an illustration of a flowchart of a process for designing negative index metamaterial unit cells in accordance with an advantageous embodiment.

With reference now to FIG. 31, an illustration of a flowchart of a process for designing negative index metamaterial unit cells is depicted in accordance with an advantageous embodiment. The process illustrated in FIG. 31 is a more detailed explanation of operation 2912 in FIG. 29.

The process begins by selecting a unit cell size for the desired operating frequency (operation 3100). In this example, a fixed unit cell size of a 2.3 millimeter cube is selected for an operating frequency of about 15 gigahertz. In these examples, the unit cell is selected to be smaller than the wavelength for effective medium theory to hold. Typical cell sizes may range from about $\lambda/5$ to about $\lambda/20$. Even smaller cell sizes may be used. In these examples, $\lambda$=free space wavelength. Although smaller unit cell sizes may be better with respect to performance, these smaller sizes may become too small such that the split ring resonators and wire structures do not have sufficient inductance and capacitance to cause a negative index metamaterial effect.

The process then creates multiple sets of parameters for the unit cell (operation 3102). These parameters are any parameters that may affect the performance of the cell with respect to permittivity, permeability, and the refractive index. Examples of features that may be varied include, for example, without limitation, a width of copper traces for the split ring resonator, width of copper traces for a wire, the amount of separation between split ring resonators, the size of split in the split ring resonator, the size of gaps in the split ring resonator, and other suitable features.

Next, the process runs a simulation on the sets of parameters over a range of frequencies (operation 3104). The simulation performed in operation 3104 may be performed using the same software to perform the simulation of the runs in operation 3004 in FIG. 30. This simulation is a full wave simulation on the unit cell over a range of frequencies.

The process then extracts s-parameters for each set of parameters (operation 3106). In these examples, an s-parameter is also referred to as a scattering parameter. These parameters are used to describe the behavior of models undergoing various steady state stimuli by small signals. In other words, the scattering parameters are values or properties used to describe the behavior of a model, such as an electrical network, undergoing various steady state stimuli by small signals.

Thereafter, the process computes permittivity, permeability, and refractive index values for each of the sets of s-parameters extracted for the different sets of parameters (operation 3108). A determination is then made as to whether any of the permeability, permittivity, and refractive indices returned are acceptable (operation 3110). If one of these sets of values is acceptable, the process terminates. Otherwise, the process returns to operation 3102 to generate additional sets of parameters for the unit cell.

Figure 32:
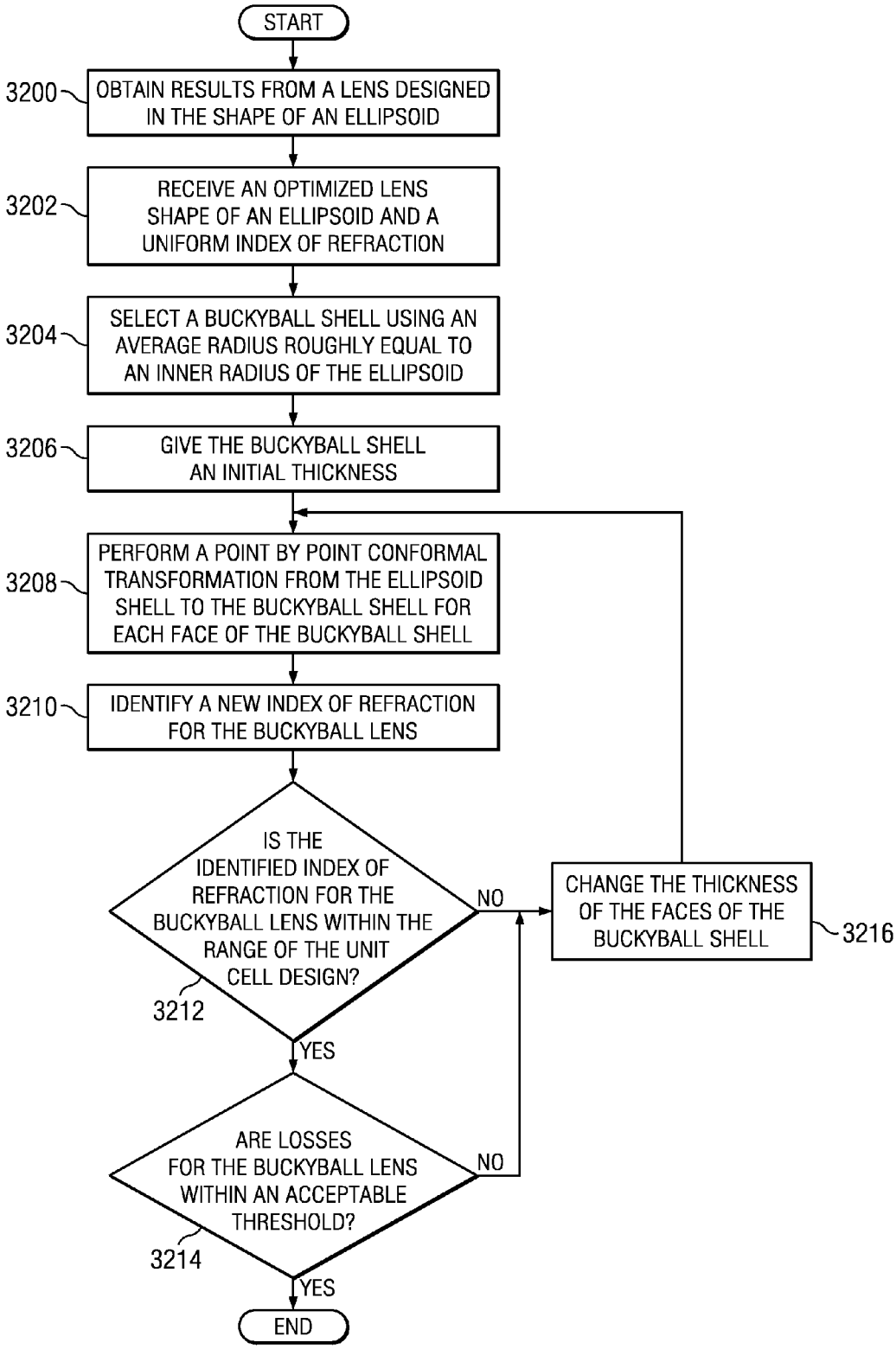
FIG. 32 is an illustration of a flowchart of a process for generating a lens design in accordance with an advantageous embodiment.

With reference now to FIG. 32, an illustration of a flowchart of a process for generating a lens design is depicted in accordance with an advantageous embodiment. The process illustrated in FIG. 32 may be used to generate a lens design having a shape of a truncated icosahedron or a buckyball. In these examples, the process illustrated in FIG. 32 may be performed using a data processing system, such as data processing system 2700 in FIG. 27.

The process may begin with obtaining results from a lens designed in the shape of an ellipsoid (operation 3200). The process receives an optimized lens shape of an ellipsoid and a uniform index of refraction (operation 3202). A buckyball shell is selected using an average radius roughly equal to an inner radius of the ellipsoid (operation 3204). The buckyball shell is selected to fit within the optimized lens shape for the ellipsoid. In this illustrative example, the buckyball shell may not have the entire buckyball shape in the form of a sphere or ball. Instead, only a portion of the buckyball shape may be used for the buckyball shell.

The buckyball shell is given an initial thickness (operation 3206). In operation 3206, the initial thickness is the thickness of each face. This thickness may be an integer multiple of a thickness of a unit cell assembly. This initial thickness may be, for example, about six unit cells in the radial direction. The initial face thickness may be selected by choosing the thickness of a corresponding point on the ellipsoid, rounded to the nearest integer multiple.

A point by point conformal transformation from the ellipsoid shell to the buckyball shell is performed for each face of the buckyball shell (operation 3208). This operation provides a lens in the shape of the buckyball shell. A new index of refraction for the buckyball lens is identified (operation 3210). The index of refraction is identified for each point in which the conformal transformation has been performed in these examples. This operation may identify a number of different indices of refraction. Different points within different faces of the buckyball shell may have different indices of refraction in these illustrative examples.

The process then determines whether the identified index of refraction for the buckyball lens is within the range of the unit cell design (operation 3212). If the index of refraction is within the unit cell design range, a determination is made as to whether losses for the buckyball lens are within an acceptable threshold (operation 3214). If the losses are acceptable in operation 3214, the process terminates.

Otherwise, if the losses are not acceptable and/or the new index of refraction for the different points in the buckyball lens are not within the unit cell design range, the process changes the thickness of the faces of the buckyball shell (operation 3216), with the process then returning to operation 3208 as described above.

Referring again to operation 3212, if the identified index of refraction is not within the range of the unit cell design, the process changes the thickness of the faces of the buckyball shell (operation 3216), with the process then returning to operation 3208 as described above.

When the design of the buckyball lens is complete, this lens may be fabricated using discrete components and the identified unit cells. Also, in some advantageous embodiments, if the unit cells are not designed to accommodate or provide the index of refraction for the different points in the buckyball lens, the unit cells may be redesigned instead of changing the thickness by changing the number of unit cell assemblies that may be stacked on top of each other for the face.

The thickness of each face may be determined by the available unit cell design and corresponding refractive index range. In this illustrative example, the unit cell designs may have a range of index of refractions of about −1.9 to about −0.6. If, after the conformal transformation, the index required is smaller than about −1.9, the thickness of that face needs to be increased to achieve the same bending power, while requiring refractive indices within the acquired range. In this example, a smaller index may be about −2.5. On the other hand, if, after the conformal transformation, the index required is greater than about −0.6, the thickness may be reduced so the index of refraction falls within the required range. In this example, the thickness is the thickness of a unit cell assembly.

The flowcharts and block diagrams in the different depicted embodiments illustrate the architecture, functionality, and operation of some possible implementations of apparatus and methods in different advantageous embodiments. In this regard, each block in the flowcharts or block diagrams may represent a module, segment, function, and/or a portion of an operation or step. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

Thus, the different advantageous embodiments present a method and apparatus for steering a radio frequency beam. The radio frequency beam is emitted from an array of antenna elements at a first angle into a lens at a location for the lens. The first angle of the radio frequency beam is changed to a second angle when the radio frequency beam exits the lens. The second angle changes when the location at which the radio frequency beam enters the lens changes. The second angle of the radio frequency beam is changed to a third angle when the radio frequency beam with the second angle passes through a negative index metamaterial lens located over the lens.

With an antenna system configured with both a gradient index lens and a negative index material lens, fewer mechanical components may be needed to steer radio frequency beams, as compared to currently used antenna systems. Further, with this type of configuration, fewer components may need to be physically adjusted to steer radio frequency beams. In this manner, the different advantageous embodiments provide a configuration for an antenna system that may require less effort and/or expense as compared to currently used antenna systems.

The description of the different advantageous embodiments has been presented for purposes of illustration and description, and it is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

an array of antenna elements configured to emit a radio frequency beam;

a lens located over the array of antenna elements, wherein the lens is configured to change a first angle at which the radio frequency beam enters the lens to a second angle when the radio frequency beam exits the lens and wherein the second angle changes when a location at which the radio frequency beam enters the lens changes, the second angle differing from the first angle; and a metamaterial lens located over the lens, the metamaterial lens having a substantially buckyball shape, wherein the metamaterial lens is configured to change the second angle at which the radio frequency beam enters the metamaterial lens to a third angle when the radio frequency beam exits the metamaterial lens, the third angle differing from the second angle.

2. The apparatus of claim 1, wherein the metamaterial lens is selected from a group consisting of a negative index metamaterial lens and a positive index metamaterial lens.

3. The apparatus of claim 1, wherein the array of antenna elements is configured to emit the radio frequency beam using a number of antenna elements in the array of antenna elements.

4. The apparatus of claim 3 further comprising:

a controller configured to select the number of antenna elements from the array of antenna elements.

5. The apparatus of claim 3, wherein the number of antenna elements is in the location.

6. The apparatus of claim 5, wherein changing the number of antenna elements changes the location.

7. The apparatus of claim 1, wherein the array of antenna elements is configured to receive a second radio frequency beam passing through the metamaterial lens and the lens.

8. The apparatus of claim 1, wherein the array of antenna elements comprises at least one of transmitters, receivers, and transceivers.

9. The apparatus of claim 1, wherein the metamaterial lens comprises a negative index material and has a buckyball shape comprising a truncated icosahedron.

10. The apparatus of claim 1, wherein the third angle is substantially horizontal with respect to a plane on which the array of antenna elements is located.

11. The apparatus of claim 1, wherein the metamaterial lens comprises a plurality of discrete components.

12. The apparatus of claim 11, wherein the plurality of discrete components comprises a plurality of metamaterial unit cells arranged in a configuration.

13. The apparatus of claim 1, wherein a number of antenna elements in the array of antenna elements is selected from one of first antenna elements in the array of antenna elements adjacent to each other and second antenna elements in the array of antenna elements not adjacent to the each other.

14. The apparatus of claim 1, wherein the lens is a flat gradient index lens.

15. The apparatus of claim 1, wherein the lens is comprised of at least one of a negative index metamaterial and a positive index metamaterial.

16. The apparatus of claim 1, wherein the radio frequency beam has a frequency from about 300 megahertz to about 300 gigahertz.

17. The apparatus of claim 1 further comprising:

a platform, wherein the array of antenna elements, the lens located over the array of antenna elements, and the metamaterial lens are associated with the platform and wherein the platform is selected from one of a mobile platform, a stationary platform, a land-based structure, an aquatic-based structure, a space-based structure, an aircraft, a surface ship, a tank, a personnel carrier, a train, a spacecraft, a space station, a satellite, a submarine, an automobile, and a building.

18. An antenna system comprising:

an array of antenna elements configured to emit a radio frequency beam;

a lens located over the array of antenna elements, wherein the lens is configured to change a first angle at which the radio frequency beam enters the lens to a second angle when the radio frequency beam exits the lens and wherein the second angle changes when a location at which the radio frequency beam enters the lens changes, the second angle differing from the first angle;

a negative index metamaterial lens located over the lens, wherein the negative index metamaterial lens has a substantially buckyball shape and is configured to change the second angle at which the radio frequency beam enters the negative index metamaterial lens to a third angle when the radio frequency beam exits the negative index metamaterial lens, the third angle differing from the second angle; and a controller configured to select a number of antenna elements from the array of antenna elements to change the location at which the radio frequency beam enters the lens.

19. A method for steering a radio frequency beam, the method comprising:

emitting the radio frequency beam from an array of antenna elements at a first angle into a lens at a location for the lens;

changing the first angle of the radio frequency beam to a second angle when the radio frequency beam exits the lens, wherein the second angle changes when the location at which the radio frequency beam enters the lens changes, the second angle differing from the first angle; and changing the second angle of the radio frequency beam to a third angle when the radio frequency beam with the second angle passes through a negative index metamaterial lens having a substantially buckyball shape located over the lens, the third angle differing from the second angle.

20. The method of claim 19 further comprising;

selecting a number of antenna elements from the array of antenna elements to emit the radio frequency beam at the location.

21. The method of claim 19, wherein the radio frequency beam is a first radio frequency beam and the location is a first location, and further comprising:

emitting a second radio frequency beam from the array of antenna elements at a fourth angle into the lens at a second location for the lens;

changing the fourth angle of the second radio frequency beam to a fifth angle when the second radio frequency beam exits the lens, wherein the fifth angle changes when the second location at which the second radio frequency beam enters the lens changes; and changing the fifth angle of the second radio frequency beam to a sixth angle when the second radio frequency beam with the fifth angle passes through the negative index metamaterial lens located over the lens.

* * * * *